US010393012B2

(12) United States Patent
Kamo et al.

(10) Patent No.: US 10,393,012 B2
(45) Date of Patent: Aug. 27, 2019

(54) INTERNAL COMBUSTION ENGINE

(71) Applicant: TOYOTA JIDOSHA KABUSHIKI KAISHA, Toyota-shi, Aichi-ken (JP)

(72) Inventors: Yoshiro Kamo, Kanagawa-ken (JP); Shuichi Ezaki, Susono (JP); Akio Kidooka, Kanagawa-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 476 days.

(21) Appl. No.: 15/151,669

(22) Filed: May 11, 2016

(65) Prior Publication Data

US 2016/0333780 A1 Nov. 17, 2016

(30) Foreign Application Priority Data

May 15, 2015 (JP) ..... 2015-100295

(51) Int. Cl.
*F02B 75/04* (2006.01)
*F01M 11/02* (2006.01)
*F01M 1/06* (2006.01)

(52) U.S. Cl.
CPC ..... *F02B 75/045* (2013.01); *F01M 11/02* (2013.01); *F01M 2001/062* (2013.01); *F01M 2011/026* (2013.01)

(58) Field of Classification Search
CPC . F02B 75/045; F01M 11/02; F01M 2001/062; F01M 2011/026
USPC ..... 123/48 B
See application file for complete search history.

(56) References Cited

U.S. PATENT DOCUMENTS 5,146,879 A * 9/1992 Kume ..... F01M 1/06 123/48 B
5,178,103 A * 1/1993 Simko ..... F02B 75/044 123/48 B
5,655,633 A * 8/1997 Nakadate ..... F16F 9/467 188/266.6

(Continued)

FOREIGN PATENT DOCUMENTS

CN 104279055 A 1/2015
DE 10233815 C1 10/2003

(Continued)

*Primary Examiner* — Hung Q Nguyen
*Assistant Examiner* — Anthony Donald Taylor, Jr.
(74) *Attorney, Agent, or Firm* — Hunton Andrews Kurth LLP

(57) ABSTRACT

The internal combustion engine comprises: operating members and operating by a predetermined pressure or more of oil pressure; a hydraulic oil path supplying hydraulic oil to the operating members through crank journals; a lubricating oil path supplying lubricating oil to crankpins through the crank journals; a hydraulic control valve linearly controlling an oil pressure supplied to the operating members due to change of that opening degree; and a control device. The control device controls the opening degree of the hydraulic control valve so that when operating the operating members, the predetermined pressure or more of oil pressure is supplied to the operating members, and controls the opening degree of the hydraulic control valve so that when not operating the operating members, less than the predetermined pressure of oil pressure is supplied to the operating members.

9 Claims, 16 Drawing Sheets

(56) References Cited

U.S. PATENT DOCUMENTS

| | | | | |
|---|---|---|---|---|
| 6,397,796 | B1 * | 6/2002 | Styron | F01M 1/02 123/78 AA |
| 6,497,203 | B1 * | 12/2002 | Rao | F02B 75/045 123/48 B |
| 6,752,105 | B2 * | 6/2004 | Gray, Jr. | F02B 75/045 123/48 B |
| 7,353,785 | B2 * | 4/2008 | Kondo | F02B 75/044 123/48 B |
| 7,654,369 | B2 * | 2/2010 | Murray | F16F 9/466 188/266.5 |
| 8,434,435 | B2 * | 5/2013 | Engineer | F02B 75/045 123/48 A |
| 2003/0182047 | A1 | 9/2003 | Boyer et al. | |
| 2007/0175422 | A1 * | 8/2007 | Takahashi | F02B 75/044 123/78 BA |
| 2011/0146602 | A1 * | 6/2011 | Kato | F01L 1/3442 123/90.12 |
| 2015/0075497 | A1 * | 3/2015 | Hutzelmann | F02B 75/044 123/48 A |
| 2015/0122077 | A1 * | 5/2015 | Melde-Tuczai | F02B 75/045 74/586 |
| 2015/0204236 | A1 * | 7/2015 | Paul | F02B 75/044 123/48 B |
| 2015/0260094 | A1 * | 9/2015 | Wittek | F02B 75/045 123/48 B |
| 2015/0260109 | A1 * | 9/2015 | Wittek | F02B 75/045 123/48 B |
| 2016/0305471 | A1 * | 10/2016 | Wittek | F16C 7/06 |

FOREIGN PATENT DOCUMENTS

| | | | |
|---|---|---|---|
| DE | 60301991 | T2 | 7/2006 |
| DE | 102012014917 | A1 | 2/2013 |
| EP | 0438121 | A1 | 1/1991 |
| EP | 0438121 | A1 | 7/1991 |
| JP | S57-57237 | U | 3/1982 |
| JP | S63-117129 | A | 5/1988 |
| JP | H05-272365 | A | 10/1993 |
| JP | H05-280382 | A | 10/1993 |
| JP | 2012-031786 | A | 2/2012 |
| JP | 2013-104353 | A | 5/2013 |
| JP | 2014-084723 | A | 5/2014 |
| WO | 2014099374 | A1 | 6/2014 |

* cited by examiner

L1
L2
5
32
32b
32c
32d
33
33a
33b
33c
34
34a
34b
34c
31
35
41
X
6

INTERNAL COMBUSTION ENGINE

CROSS-REFERENCE TO RELATED APPLICATION

The present application claims priority to Japanese Patent Application No. 2015-100295 filed on May 15, 2015, which is incorporated herein by reference in its entirety.

TECHNICAL FIELD

The present invention relates to an internal combustion engine.

BACKGROUND ART

Known in the past has been an internal combustion engine wherein operating members (stopper pins) provided at connecting rods are made to operate by supplying hydraulic oil from an oil feed device through a main gallery, crank journals, and crankpins to the operating members (for example, PLT 1). In such an internal combustion engine, the hydraulic oil path supplying oil for making the operating members operate is made a single path and the load of the oil feed device is reduced by supplying the hydraulic oil path with hydraulic oil only when making the operating members operate.

CITATION LIST

Patent Literature

PLT 1. Japanese Patent Publication No. 5-272365A
PLT 2. Japanese Patent Publication No. 2014-084723A
PLT 3. Japanese Patent Publication No. 2012-031786A

SUMMARY OF INVENTION

Technical Problem

However, in such an internal combustion engine, during the period when not making the operating members operate, oil is not supplied to the crank journals at which the hydraulic oil path is formed. For this reason, during operation of the internal combustion engine, the crank journals are liable to end up seizing.

Therefore, to suppress seizing of the crank journals, it may be considered to supply hydraulic oil of a low oil pressure to the crank journals even while not making the operating members operate. However, the oil pressure of hydraulic oil fluctuates according to the engine speed or temperature of the hydraulic oil, so the operating members are liable to mistakenly operate due to fluctuation of the oil pressure.

Therefore, in consideration of the above problem, an object of the present invention is to provide an internal combustion engine able to suppress seizing of all of the crank journals without causing mistaken operation of the operating members to which hydraulic oil is supplied through the crank journals.

Solution to Problem

In order to solve the above problem, in a first invention, there is provided an internal combustion engine comprising operating members provided at a connecting rod and operating by a predetermined pressure or more of oil pressure, a hydraulic oil path supplying hydraulic oil from an oil feed device to the operating members through part of crank journals among a plurality of crank journals, and a lubricating oil path supplying lubricating oil from the oil feed device to crankpins through the remaining crank journals among the plurality of crank journals, characterized in that the internal combustion engine further comprises a hydraulic control valve provided in the hydraulic oil path and linearly controlling an oil pressure supplied to the operating members due to change of that opening degree, and a control device controlling the opening degree of the hydraulic control valve, and that the control device controls the opening degree of the hydraulic control valve so that when operating the operating members, the predetermined pressure or more of oil pressure is supplied to the operating members, and controls the opening degree of the hydraulic control valve so that when not operating the operating members, less than the predetermined pressure of oil pressure is supplied to the operating members.

In a second invention, if the control device does not operate the operating members, the control device makes the opening degree of the hydraulic control valve smaller when a temperature of the hydraulic oil is relatively low compared with when the temperature of the hydraulic oil is relatively high, and makes the opening degree of the hydraulic control valve smaller when an engine speed is relatively high compared with when the engine speed is relatively small, in the first invention.

In a third invention, the engine further comprises a hydraulic sensor provided in the hydraulic oil path at the operating members side from the hydraulic control valve and detecting an oil pressure supplied to the operating members, and the control device controls the opening degree of the hydraulic control valve based on an output of the hydraulic sensor, in the first or second invention.

In a fourth invention, the hydraulic oil path is communicated with the lubricating oil path at a position at an upstream side from the part of crank journals in a direction of oil flow and at a downstream side of the hydraulic control valve in the direction of oil flow so that an oil pressure of less than the predetermined pressure is supplied from the lubricating oil path to the part of crank journals when the lubricating oil path is supplied with the lubricating oil, in any one of the first to third inventions.

In a fifth invention, a main gallery formed in a cylinder block is formed with two passages, these passages respectively form parts of the hydraulic oil path and lubricating oil path, the hydraulic oil is supplied from the main gallery to the part of crank journals, and the lubricating oil is supplied from the main gallery to the remaining crank journals, in any one of the first to fourth inventions.

In a sixth invention, one of the remaining crank journals is a crank journal closest to a timing belt, in any one of the first to fifth inventions.

Advantageous Effects of Invention

According to the present invention, there is provided an internal combustion engine able to suppress seizing of all of the crank journals without causing mistaken operation of the operating members to which hydraulic oil is supplied through the crank journals.

DESCRIPTION OF EMBODIMENTS

Figure 1:
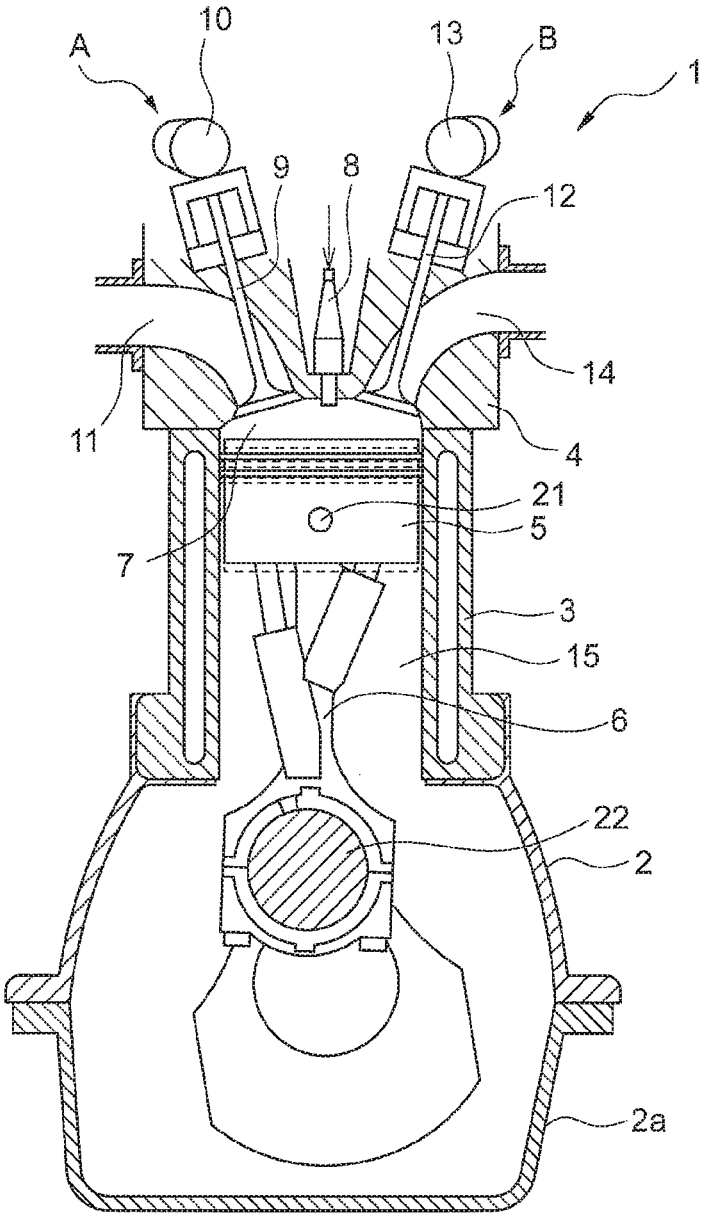
FIG. 1 is a schematic side cross-sectional view of an internal combustion engine according to the present invention.

Below, referring to the drawings, an embodiment of the present invention will be explained in detail. Note that, in the following explanation, similar component elements are assigned the same reference notations.

<Internal Combustion Engine>

FIG. 1 is a schematic side cross-sectional view of an internal combustion engine according to the present invention. In the present embodiment, the internal combustion engine 1 is a variable compression ratio internal combustion engine able to change a mechanical compression ratio. The internal combustion engine 1 comprises a crankshaft case 2, cylinder block 3, cylinder head 4, pistons 5, variable length connecting rods 6, combustion chambers 7, spark plugs 8 arranged at the center parts of top surfaces of the combustion chambers 7, intake valves 9, an intake camshaft 10, intake ports 11, exhaust valves 12, an exhaust camshaft 13, and exhaust ports 14. The cylinder block 3 forms cylinders 15. The pistons 5 reciprocate inside the cylinders 15. Further, the internal combustion engine 1 further comprises a variable valve timing mechanism A able to control the opening timing and closing timing of the intake valves 9, and a variable valve timing mechanism B able to control the opening timing and closing timing of the exhaust valves 12.

The variable length connecting rod 6 is connected at a small diameter end part thereof by a piston pin 21 to the piston 5, and is connected at a large diameter end part thereof to a crank pin 22 of the crankshaft. The variable length connecting rod 6, as explained later, can change the distance from the axis of the piston pin 21 to the axis of the crank pin 22, that is, the effective length.

If the effective length of the variable length connecting rod 6 becomes longer, the length from the crank pin 22 to the piston pin 21 is longer, and therefore as shown by the solid line in the figure, the volume of the combustion chamber 7 when the piston 5 is at top dead center is smaller. On the other hand, even if the effective length of the variable length connecting rod 6 changes, the stroke length of the piston 5 reciprocating in the cylinder does not change. Therefore, at this time, the mechanical compression ratio at the internal combustion engine 1 is larger.

On the other hand, if the effective length of the variable length connecting rod 6 is shorter, the length from the crank pin 22 to the piston pin 21 is shorter, and therefore as shown by the broken line in the figure, the volume of the combustion chamber when the piston 5 is at top dead center is larger. However, as explained above, the stroke length of the piston 5 is constant. Therefore, at this time, the mechanical compression ratio at the internal combustion engine 1 is smaller.

<Configuration of Variable Length Connecting Rod>

Figure 2:
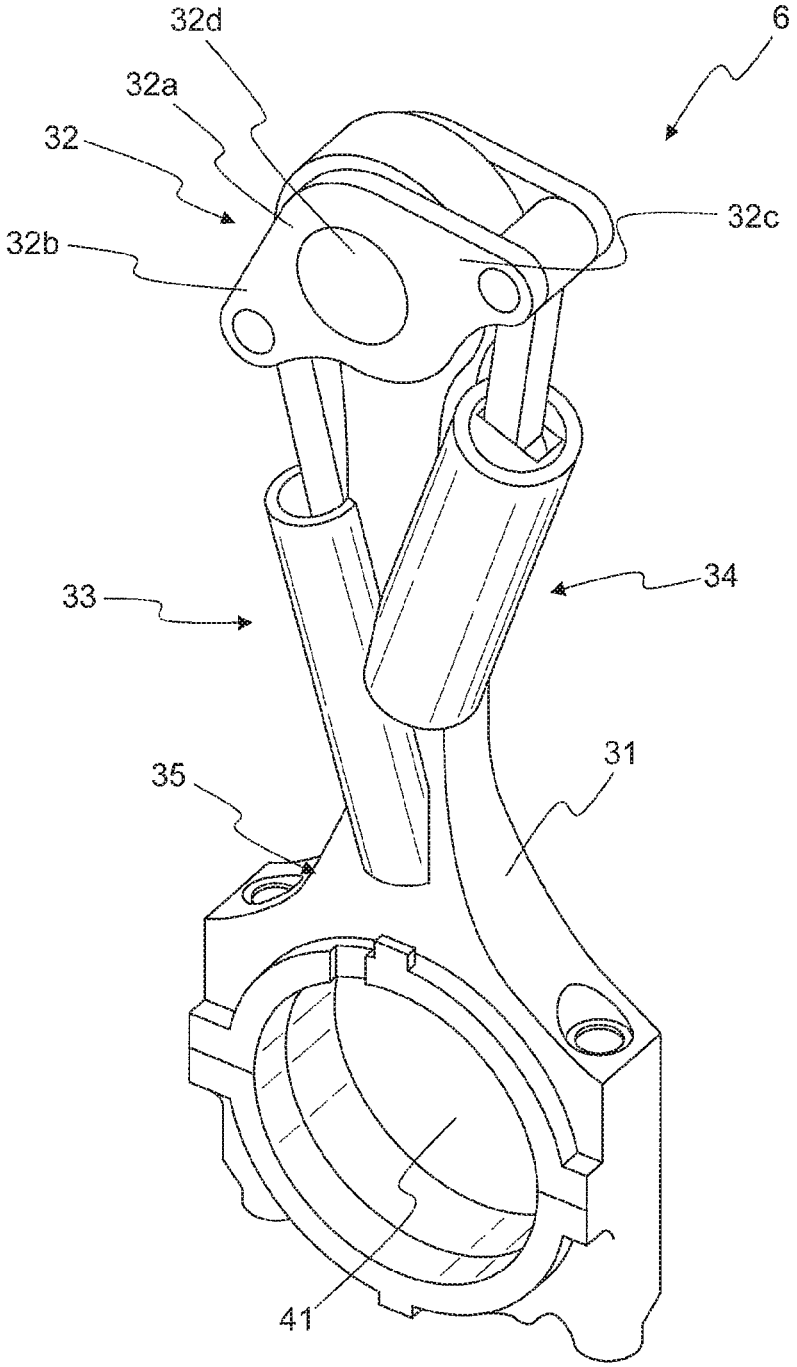
FIG. 2 is a perspective view schematically showing a variable length connecting rod according to the present invention.
Figure 3:
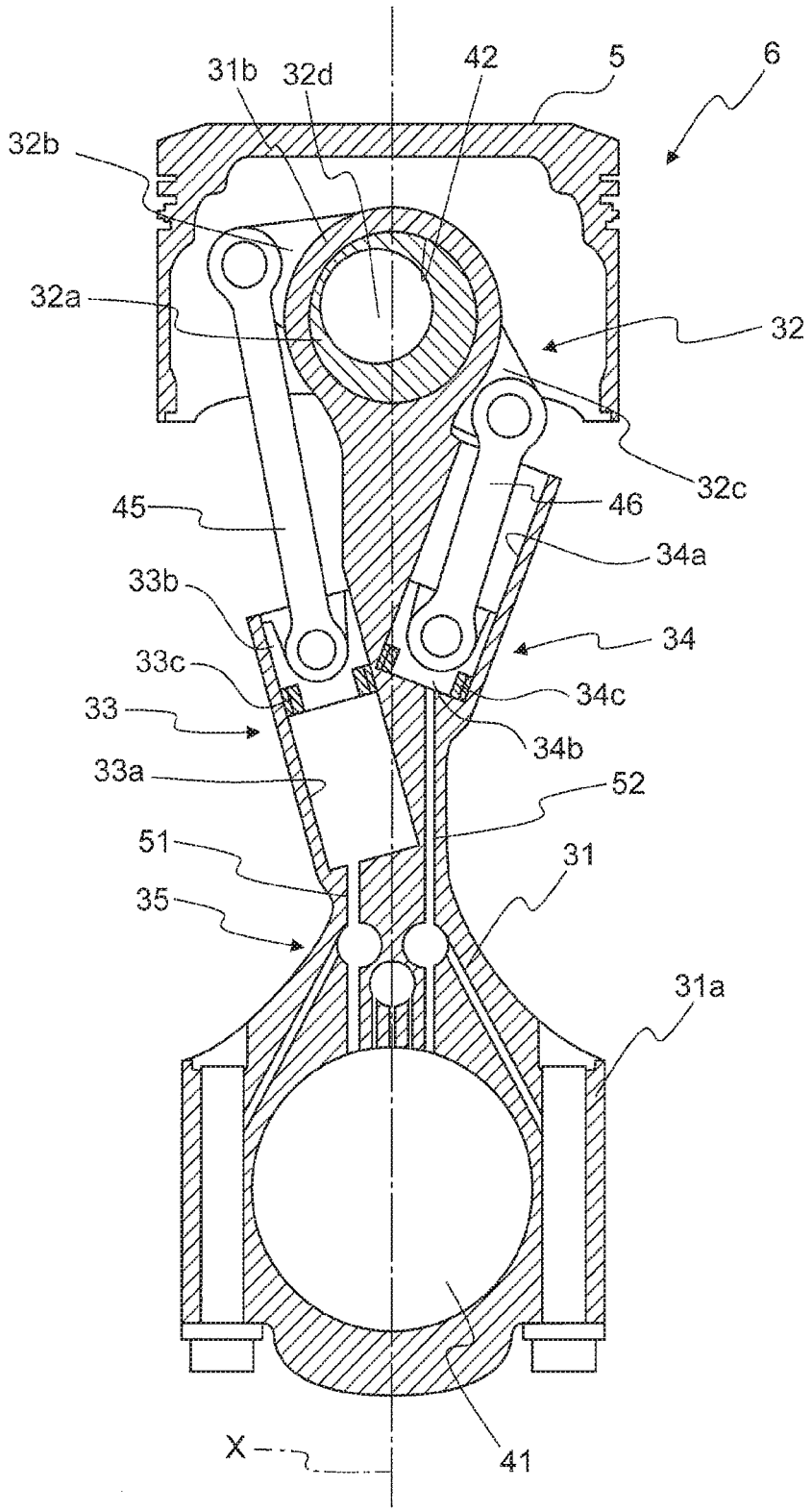
FIG. 3 is a cross-sectional side view schematically showing a variable length connecting rod and piston according to the present invention.

FIG. 2 is a perspective view which schematically shows the variable length connecting rod 6 according to the present invention, while FIG. 3 is a cross-sectional side view which schematically shows the variable length connecting rod 6 according to the present invention. As shown in FIG. 2 and FIG. 3, the variable length connecting rod 6 comprises a connecting rod body 31, an eccentric member 32 which is attached to the connecting rod body 31 to be able to swivel, a first piston mechanism 33 and a second piston mechanism 34 which are provided at the connecting rod body 31, and a flow direction switching mechanism 35 which switches the flow of hydraulic oil to these piston mechanisms 33 and 34.

First, the connecting rod body 31 will be explained. The connecting rod body 31 has at one end a crank pin receiving opening 41 which receives the crank pin 22 of the crankshaft, and has at the other end a sleeve receiving opening 42 which receives a sleeve of the later explained eccentric member 32. The crank pin receiving opening 41 is larger than the sleeve receiving opening 42, and therefore the end of the connecting rod body 31 positioned at the side where the crank pin receiving opening 41 is provided (the crankshaft side), will be called a large diameter end part 31*a*, while the end of the connecting rod body 31 positioned at the side where the sleeve receiving opening 42 is provided (the piston side), will be called a small diameter end part 31*b*.

Note that, in this Description, an axis X extending between a center axis of the crank pin receiving opening 41 (that is, the axis of the crank pin 22 received in the crank pin receiving opening 41) and a center axis of the sleeve receiving opening 42 (that is, the axis of the sleeve received in the sleeve receiving opening 42) (FIG. 3), that is, the line passing through the center of the connecting rod body 31, will be called the "axis of the connecting rod 6". Further, the length of the connecting rod in the direction perpendicular to the axis X of the connecting rod 6 and perpendicular to the center axis of the crank pin receiving opening 41 will be called the "width of the connecting rod". In addition, the length of the connecting rod in the direction parallel to the center axis of the crank pin receiving opening 41 will be called the "thickness of the connecting rod".

As will be understood from FIG. 2 and FIG. 3, the width of the connecting rod body 31 is narrowest at the intermediate part between the large diameter end part 31*a* and the small diameter end part 31*b*. Further, the width of the large diameter end part 31*a* is larger than the width of the small diameter end part 31*b*. On the other hand, the thickness of the connecting rod body 31 is substantially a constant thickness, except for the region at which the piston mechanisms 33, 34 are provided.

Figure 4:
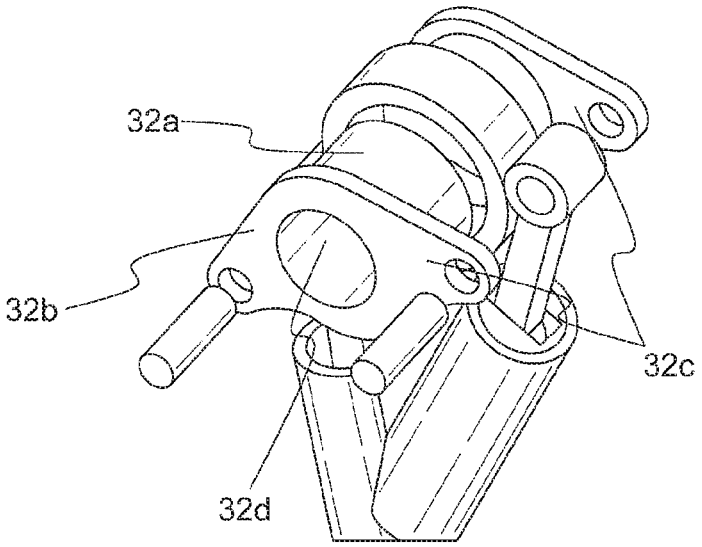
FIG. 4 is a schematic disassembled perspective view of a vicinity of a small diameter end part of a connecting rod body.
Figure 5:
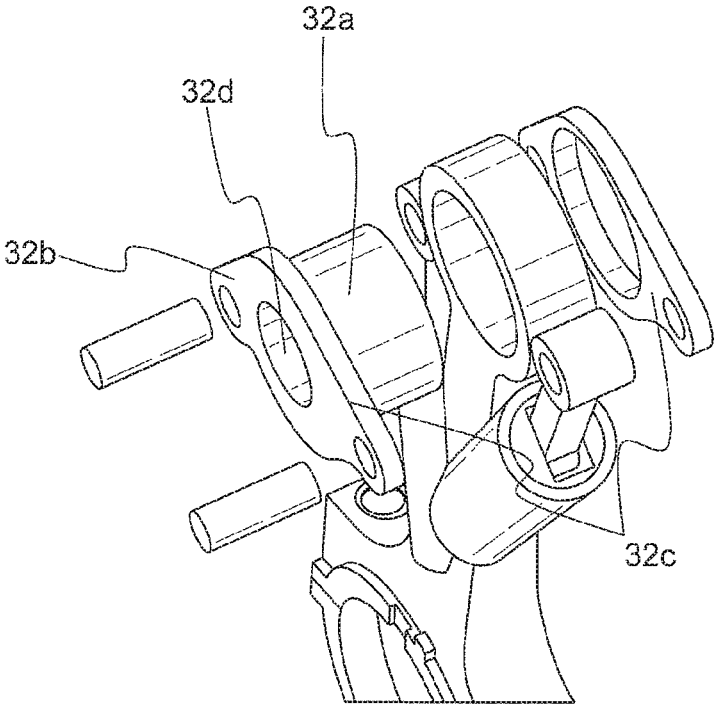
FIG. 5 is a schematic disassembled perspective view of a vicinity of a small diameter end part of a connecting rod body.

Next, the eccentric member 32 will be explained. FIG. 4 and FIG. 5 are schematic perspective views of the vicinity of the small diameter end part 31*b* of the connecting rod body 31. In FIG. 4 and FIG. 5, the eccentric member 32 is shown in the disassembled state. Referring to FIG. 2 to FIG. 5, the eccentric member 32 comprises: a cylindrical sleeve 32*a* received in a sleeve receiving opening 42 formed in the connecting rod body 31; a pair of first arms 32*b* extending from the sleeve 32*a* in one direction of the width direction of the connecting rod body 31; and a pair of second arms 32*c* extending from the sleeve 32*a* in the other direction of the width direction of the connecting rod body 31 (direction generally opposite to above one direction). The sleeve 32*a* can swivel in the sleeve receiving opening 42, and therefore the eccentric member 32 is attached to be able to swivel in the circumferential direction of the small diameter end part 31 with respect to the connecting rod body 31 in the small diameter end part 31*b* of the connecting rod body 31. The swiveling axis of the eccentric member 32 matches the center axis of the sleeve receiving opening 42.

Further, the sleeve 32*a* of the eccentric member 32 has a piston pin receiving opening 32*d* for receiving a piston pin 21. This piston pin receiving opening 32*d* is formed in a cylindrical shape. The cylindrical piston pin receiving opening 32*d* has an axis parallel to the center axis of the cylindrical shape of the sleeve 32*a*, but is formed so as not to become coaxial with it. Therefore, the axis of the piston pin receiving opening 32*d* is offset from the center axis of the cylindrical external shape of the sleeve 32*a*, i.e., the swiveling axis of the eccentric member 32.

In this way, in the present embodiment, the center axis of the piston pin receiving opening 32*d* of the sleeve 32*a* is offset from the swiveling axis of the eccentric member 32. Therefore, if the eccentric member 32 swivels, the position of the piston pin receiving opening 32*d* in the sleeve receiving opening 42 changes. When the position of the piston pin receiving opening 32*d* is at the large diameter end part 31*a* side in the sleeve receiving opening 42, the effective length of the connecting rod 6 becomes shorter. Conversely, when the position of the piston pin receiving opening 32*d* is at the opposite side to the large diameter end part 31*a* side in the sleeve receiving opening 42, i.e., the small diameter end part 31*b* side, the effective length of the connecting rod becomes longer. Therefore, according to the present embodiment, by swiveling the eccentric member, the effective length of the connecting rod 6 changes.

Next, referring to FIG. 3, the first piston mechanism 33 will be explained. The first piston mechanism 33 has a first cylinder 33*a* formed in the connecting rod body 31, a first piston 33*b* sliding in the first cylinder 33*a*, and a first oil seal 33*c* sealing the oil supplied into the first cylinder 33*a*. The first cylinder 33*a* is almost entirely or entirely arranged at the first arm 32*b* side from the axis X of the connecting rod 6. Further, the first cylinder 33*a* is arranged slanted by a certain extent of angle with respect to the axis X so that it sticks out further in the width direction of the connecting rod body 31 the closer to the small diameter end part 31*b*. Further, the first cylinder 33*a* is communicated with the flow direction switching mechanism 35 through a first piston communicating fluid path 51.

The first piston 33*b* is connected with the first arm 32*b* of the eccentric member 32 by a first connecting member 45. The first piston 33*b* is connected by a pin to the first connecting member 45 to be able to rotate. As shown in FIG. 5, the first arm 32*b* is connected to the first connecting member 45 by a first pin to be able to rotate, at the end part opposite to the side connected to the sleeve 32*a*.

The first oil seal 33*c* has a ring shape and is attached to the circumference of the bottom end part of the first piston 33*b*. The first oil seal 33*c* contacts the inner surface of the first cylinder 33*a*. Frictional force is generated between the first oil seal 33*c* and the first cylinder 33*a*.

Next, the second piston mechanism 34 will be explained. The second piston mechanism 34 has a second cylinder 34*a* formed in the connecting rod body 31, a second piston 34*b* sliding in the second cylinder 34*a*, and a second oil seal 34*c* sealing the oil supplied into the second cylinder 34*a*. The second cylinder 34*a* is almost entirely or entirely arranged at the second arm 32*c* side with respect to the axis X of the connecting rod 6. Further, the second cylinder 34*a* is arranged slanted by a certain extent of angle with respect to the axis X so that it sticks out further in the width direction of the connecting rod body 31 the closer to the small diameter end part 31*b*. Further, the second cylinder 34*a* is communicated with the flow direction changing mechanism 35 through a second piston communicating fluid path 52.

The second piston 34*b* is connected by a second connecting member 46 to the second arm 32*c* of the eccentric member 32. The second piston 34*b* is connected by a pin to the second connecting member 46 to be able to rotate. As shown in the FIG. 5, the second arm 32*c* is connected by a second pin to the second connecting member 46 to be able to rotate at the end part of the opposite side to the side connected to the sleeve 32*a*.

The second oil seal 34*c* has a ring shape and is attached to the circumference of the bottom end part of the second piston 34*b*. The second oil seal 34*c* contacts the inner surface of the second cylinder 34*a*. Frictional force is generated between the second oil seal 43*c* and the second cylinder 34*a*.

<Operation of Variable Length Connecting Rod>

Next, referring to FIG. 6, the operation of the thus configured eccentric member 32, first piston mechanism 33, and second piston mechanism 34 will be explained. FIG. 6(A) shows the state where oil is fed to the first cylinder 33*a* of the first piston mechanism 33 and oil is not fed to the second cylinder 34*a* of the second piston mechanism 34. On the other hand, FIG. 6(B) shows the state where oil is not fed to the first cylinder 33*a* of the first piston mechanism 33 and oil is fed to the second cylinder 34*a* of the second piston mechanism 34.

In this regard, as explained later, the flow direction changing mechanism 35 can be switched between a first state where it prohibits the flow of oil from the first cylinder 33*a* to the second cylinder 34*a* and permits the flow of oil from the second cylinder 34*a* to the first cylinder 33*a*, and a second state where it permits the flow of oil from the first cylinder 33*a* to the second cylinder 34*a* and prohibits the flow of oil from the second cylinder 34*a* to the first cylinder 33*a*.

Figures 6A, 6B:
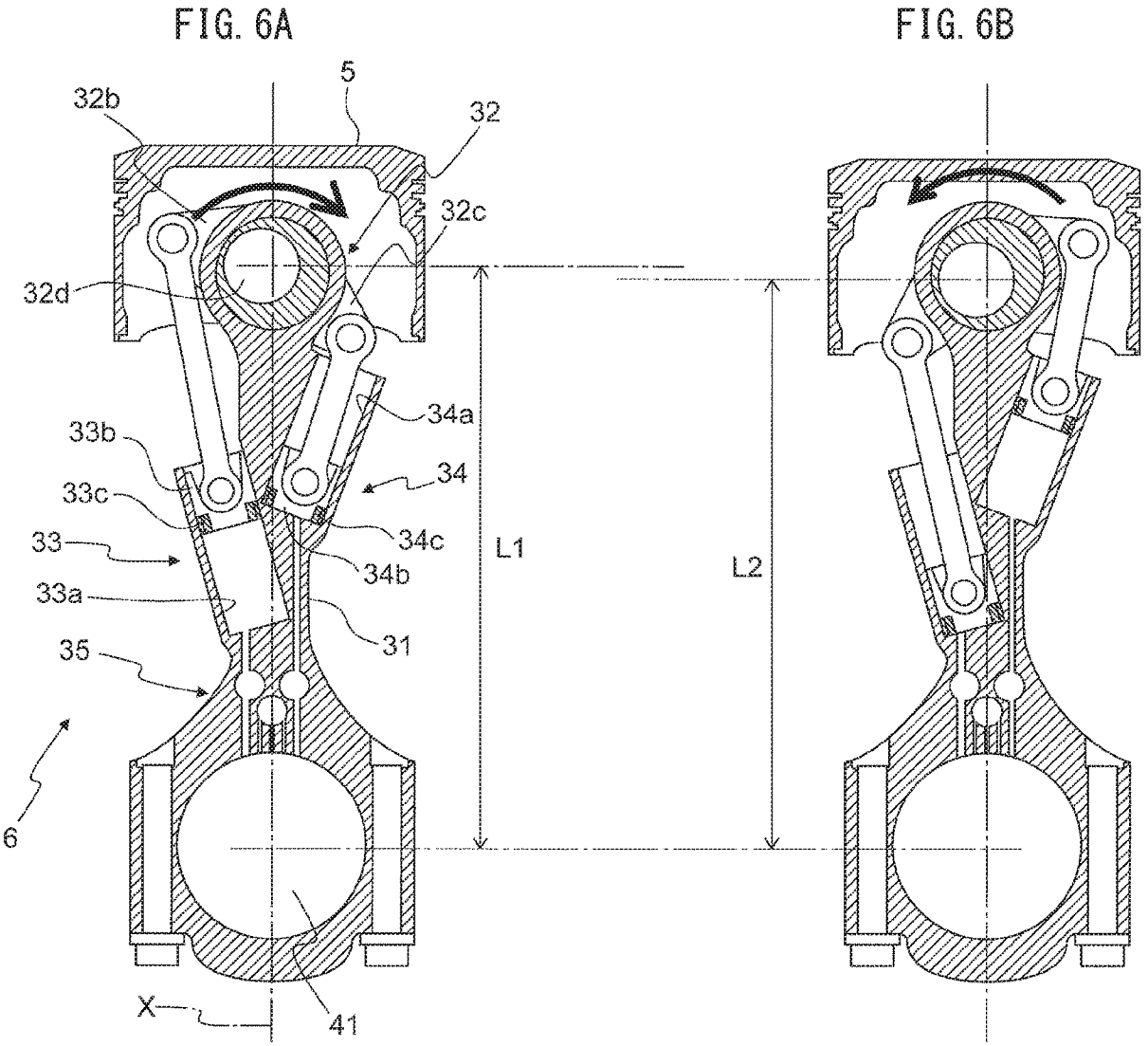
FIGS. 6A and 6B are cross-sectional side views schematically showing a variable length connecting rod and piston according to the present invention.

When the flow direction changing mechanism 35 is in the first state where it prohibits flow of oil from the first cylinder 33*a* to the second cylinder 34*a* and permits flow of oil from the second cylinder 34*a* to the first cylinder 33*a*, as shown in FIG. 6(A), oil is fed to the first cylinder 33*a* and oil is discharged from the second cylinder 34*a*. Therefore, the first piston 33*b* rises and the first arm 32*b* of the eccentric member 32 connected to the first piston 33*b* also rises. On the other hand, the second piston 34*b* descends and the second arm 32*c* connected to the second piston 34*b* also descends. As a result, in the example shown in FIG. 6(A), the eccentric member 32 swivels in the arrow direction of the figure and as a result the position of the piston pin receiving opening 32*d* rises. Therefore, the length between the center of the crank receiving opening 41 and the center of the piston pin receiving opening 32*d*, that is, the effective length of the connecting rod 6, becomes longer and becomes L1 in the figure. That is, if oil is fed to the inside of the first cylinder 33*a* and oil is discharged from the second cylinder 34*a*, the effective length of the connecting rod 6 becomes longer.

On the other hand, if the flow direction changing mechanism 35 is in the second state where it permits the flow of oil from the first cylinder 33*a* to the second cylinder 34*a* and prohibits the flow of oil from the second cylinder 34*a* to the first cylinder 33*a*, as shown in FIG. 6(B), oil is fed to the inside of the second cylinder 34*a* and oil is discharged from the first cylinder 33*a*. Therefore, the second piston 34*b* rises and the second arm 32*c* of the eccentric member 32 connected to the second piston 34*b* also rises. On the other hand, the first piston 33*b* descends and the first arm 32*b* connected to the first piston 33*b* also descends. As a result, in the example shown in FIG. 6(B), the eccentric member 32 swivels in the arrow direction in the figure (direction opposite to arrow of FIG. 6(A)) and, as a result, the position of the piston pin receiving opening 32*d* descends. Therefore, the length between the center of the crank receiving opening 41 and the center of the piston pin receiving opening 32*d*, that is, the effective length of the connecting rod 6, becomes L2 shorter than L1 in the figure. That is, if oil is fed to the inside of the second cylinder 34*a* and oil is discharged from the first cylinder 33*a*, the effective length of the connecting rod 6 becomes shorter.

Therefore, in the connecting rod 6 according to the present embodiment, as explained above, the effective length of the connecting rod 6 can be switched between L1 and L2, by switching the flow direction changing mechanism 35 between the first state and the second state. As a result, in the internal combustion engine 1 using the connecting rod 6, it is possible to change the mechanical compression ratio.

Here, when the flow direction switching mechanism 35 is in the first state, basically, oil is not supplied from the outside. As explained below, the first piston 33*b* and the second piston 34*b* move to the positions shown in FIG. 6A and the eccentric member 32 swivels to the position shown in FIG. 6A. If an upward inertial force due to reciprocating motion of the piston 5 inside the cylinder 15 of the internal combustion engine 1 acts on the piston pin 21, the first piston 33*b* rises and the second piston 34*b* descends. At this time, oil is discharged from the second cylinder 34*a*, oil is supplied to the inside of the first cylinder 33*a*, and the first piston 33*b* and the second piston 34*b* move to the positions shown in FIG. 6A. Further, if an upward inertial force acts on the piston pin 21, the eccentric member 32 swivels in one direction (direction of the arrow mark in FIG. 6A) (below, referred to as the "high compression ratio direction") to the position shown in FIG. 6A. As a result of this, the effective length of the connecting rod 6 becomes longer and the piston 5 rises with respect to the connecting rod body 31. On the other hand, when the piston 5 reciprocates inside the cylinder 15 of the internal combustion engine 1 and a downward inertial force acts on the piston pin 21 or when the air-fuel mixture is burned inside the combustion chamber 7 and a downward force acts on the piston pin 21, the first piston 33*b* descends and the eccentric member 32 tries to swivel in the other direction (direction of the arrow mark in FIG. 6B) (below, referred to as the "low compression ratio direction"). However, due to the flow direction switching mechanism 35, the flow of oil from the first cylinder 33*a* to the second cylinder 34*a* is prohibited, so the oil inside the first cylinder 33*a* does not flow out and accordingly the first piston 33*b* and eccentric member 32 do not move.

On the other hand, even when the flow direction switching mechanism 35 is in the second state, basically oil is not supplied from the outside. As explained below, the eccentric member 32 swivels to the position shown by FIG. 6B, while the first piston 33*b* and the second piston 34*b* move to the positions shown in FIG. 6B. If the downward inertial force due to the reciprocating motion of the piston 5 inside the cylinder 15 of the internal combustion engine 1 and the downward explosive force due to combustion of the air-fuel mixture inside the combustion chamber 7 act on the piston pin 21, the first piston 33*b* descends and the second piston 34*b* rises. At this time, oil is discharged from the first cylinder 33*a*, oil is supplied to the inside of the second cylinder 34*a*, and the first piston 33*b* and the second piston 34*b* move to the positions shown by FIG. 6B. Further, if the downward inertial force and explosive force act on the piston pin 21, the eccentric member 32 swivels in the low compression ratio direction to the position shown in FIG. 6B. As a result of this, the effective length of the connecting rod 6 becomes shorter and the piston 5 descends with respect to the connecting rod body 31. On the other hand, when the piston 5 reciprocates inside the cylinder 15 of the internal combustion engine 1 and an upward inertial force acts on the piston pin 21, the second piston 34*b* tries to descend and the eccentric member 32 tries to swivel in the high compression ratio direction. However, due to the flow direction switching mechanism 35, the flow of oil from the second cylinder 34*a* to the first cylinder 33*a* is prohibited, so the oil in the second cylinder 34*a* does not flow out and therefore the second piston 34*b* and eccentric member 32 do not move.

Therefore, in the internal combustion engine 1, the mechanical compression ratio is switched by the inertial force from the low compression ratio to the high compression ratio and is switched by the inertial force and explosive force from the high compression ratio to the low compression ratio.

<Configuration of Flow Direction Switching Mechanism>

Figure 7:
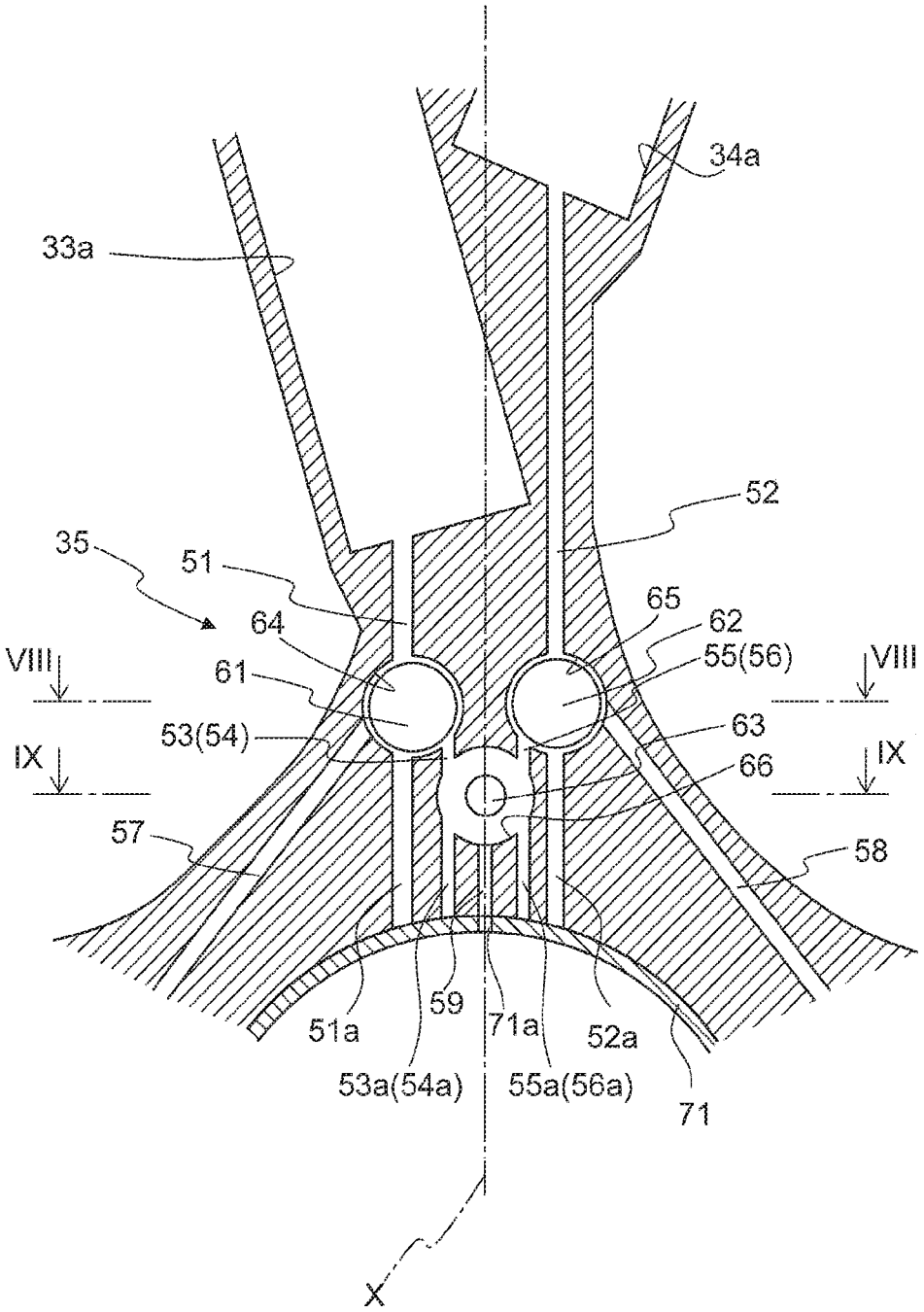
FIG. 7 is a cross-sectional side view of a connecting rod enlarging a region where a flow direction switching mechanism is provided.
Figure 8A:
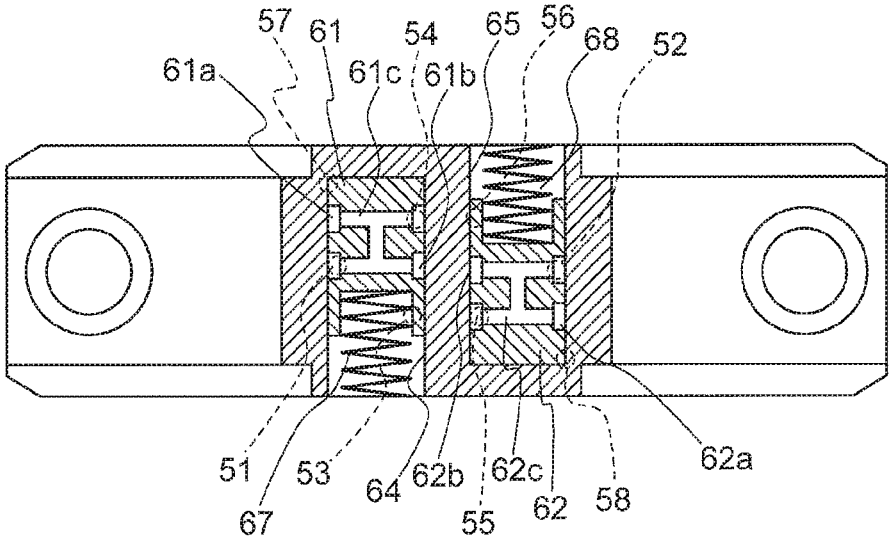
FIGS. 8A and 8B are cross-sectional views of a connecting rod along VIII-VIII and IX-IX of FIG. 7.
Figure 8B:
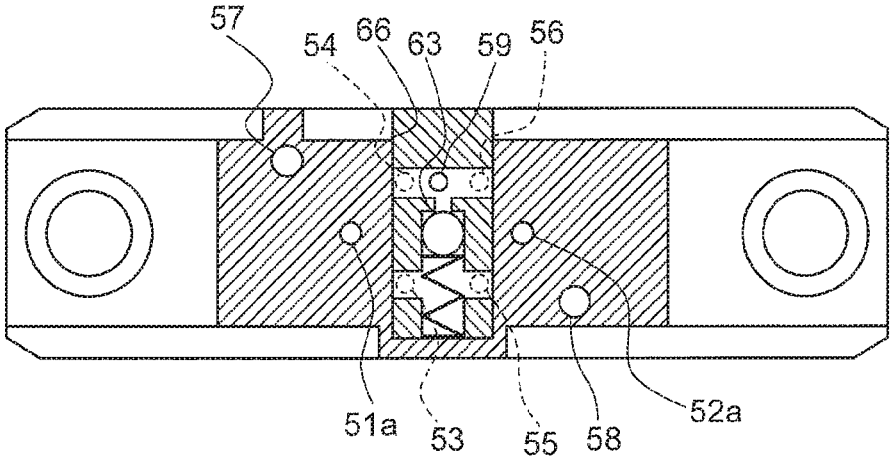

Next, referring to FIG. 7 and FIGS. 8A and 8B, the configuration of the flow direction switching mechanism 35 will be explained. FIG. 7 is a cross-sectional side view of a connecting rod enlarging the region in which the flow direction switching mechanism 35 is provided. FIG. 8A is a cross-sectional view of a connecting rod along VIII-VIII of FIG. 7, while FIG. 8B is a cross-sectional view of a connecting rod along IX-IX of FIG. 7. As explained above, the flow direction switching mechanism 35 is a mechanism switching between a first state prohibiting the flow of oil from the first cylinder 33*a* to the second cylinder 34*a* and permitting the flow of oil from the second cylinder 34*a* to the first cylinder 33*a*, and a second state permitting the flow of oil from the first cylinder 33*a* to the second cylinder 34*a* and prohibiting the flow of oil from the second cylinder 34*a* to the first cylinder 33*a*.

The flow direction switching mechanism 35, as shown in FIG. 7, comprises two switching pins 61, 62 and one check valve 63. These two switching pins 61, 62 and check valve 63 are arranged between the first cylinder 33*a* and the second cylinder 34*a*, and the crank pin receiving opening 41 in the axis X direction of the connecting rod body 31. Further, the check valve 63 is arranged to the crank pin receiving opening 41 side from the two switching pins 61, 62 in the axis X direction of the connecting rod body 31.

Furthermore, the two switching pins 61, 62 are provided at the both sides of the axis X of the connecting rod body 31 while the check valve 63 is provided on the axis X. Accordingly, it is possible to suppress a drop in the left and right balance of weight of the connecting rod body 31 due to provision of the switching pins 61, 62 and check valve 63 in the connecting rod body 31.

The two switching pins 61, 62 are respectively held in the cylindrical pin holding spaces 64, 65. In the present embodiment, the pin holding spaces 64, 65 are formed so that their axes extend in parallel with the center axis of the crank pin receiving opening 41. The switching pins 61, 62 can slide in the pin holding spaces 64, 65 in the direction in which the pin holding space 64 extends. That is, the switching pins 61, 62 are arranged in the connecting rod body 31 so that their operating directions become parallel to the center axis of the crank pin receiving opening 41.

Further, among the two pin holding spaces 64, 65, the first pin holding space 64 which holds the first switching pin 61, as shown in FIG. 8A, is formed as a pin holding hole which is opened to one side surface of the connecting rod body 31 and is closed to the other side surface of the connecting rod body 31. In addition, among the two pin holding spaces 64, 65, the second pin holding space 65 which holds the second switching pin 62, as shown in FIG. 8A, is formed as a pin holding hole which is opened to the other side surface of the connecting rod body 31 and is closed to the one side surface.

The first switching pin 61 has two circumferential grooves 61*a*, 61*b* which extend in the circumferential direction. These circumferential grooves 61*a*, 61*b* are communicated with each other by a communicating path 61*c* formed in the first switching pin 61. Further, in the first pin holding space 64. a first biasing spring 67 is held. Due to this first biasing spring 67, the first switching pin 61 is biased in a direction parallel to the center axis of the crank pin receiving opening 41. In particular, in the example shown in FIG. 8A, the first switching pin 61 is biased toward the closed end of the first pin holding space 64.

Similarly, the second switching pin 62 also has two circumferential grooves 62*a*, 62*b* which extend in the circumferential direction. These circumferential groove 62*a* and 62*b* are communicated with each other by a communicating path 62*c* formed in the second switching pin 62. Further, in the second pin holding space 65, a second biasing spring 68 is held. Due to this second biasing spring 68, the second switching pin 62 is biased in a direction parallel to the center axis of the crank pin receiving opening 41. In particular, in the example shown in FIG. 8A, the second switching pin 62 is biased toward the closed end of the second pin holding space 65.

In addition, the first switching pin 61 and the second switching pin 62 are arranged in opposite directions to each other in directions parallel to the center axis of the crankshaft receiving opening 41. In addition, the second switching pin 62 is biased in the opposite direction to the first switching pin 61. For this reason, in the present embodiment, the operating directions of these first switching pin 61 and second switching pin 62 when these first switching pin and second switching pin 62 are supplied with oil pressure become opposite to each other.

The check valve 63 is held in a cylindrical check valve holding space 66. In the present embodiment, the check valve holding space 66 is formed to extend in parallel with the center axis of the crank pin receiving opening 41. The check valve 63 can move in the check valve holding space 66 in the direction in which the check valve holding space 66 extends. Therefore, the check valve 63 is arranged in the connecting rod body so that its direction of operation is parallel with the center axis of the crank pin receiving opening 41. Further, the check valve holding space 66 is formed as a check valve holding hole which is opened to one side surface of the connecting rod body 31 and is closed to the other side surface of the connecting rod body 31.

The check valve 63 is configured to permit flow from a primary side (in FIG. 8B, top side) to the secondary side (in FIG. 8B, bottom side) and to prohibit the flow from the secondary side to the primary side.

The first pin holding space 64 holding the first switching pin 61 is communicated with the first cylinder 33*a* through the first piston communicating oil path 51. As shown in FIG. 8A, the first piston communicating oil path 51 is communicated with the first pin holding space 64 near the center of the connecting rod body 31 in the thickness direction. Further, the second pin holding space 65 holding the second switching pin 62 is communicated with the second cylinder 34*a* through the second piston communicating oil path 52. As shown in FIG. 8A, the second piston communicating oil path 52 is also communicated with the second pin holding space 65 near the center of the connecting rod body 31 in the thickness direction.

Note that, the first piston communicating oil path 51 and the second piston communicating oil path 52 are formed by cutting from the crankshaft receiving opening 41 by a drill etc. Therefore, at the crankshaft receiving opening 41 sides of the first piston communicating oil path 51 and the second piston communicating oil path 52, the first extended oil path 51*a* and the second extended oil path 52*a* coaxial with these piston communicating oil paths 51 and 52 are formed. In other words, the first piston communicating oil path 51 and the second piston communicating oil path 52 are formed so that the crankshaft receiving opening 41 is positioned on their extensions. These first extended oil path 51*a* and second extended oil path 52*a* are, for example, closed by bearing metal 71 provided inside the crankshaft receiving opening 41.

The first pin holding space 64 holding the first switching pin 61 is communicated with the check valve holding space 66 through two space communicating oil paths 53 and 54. Among these, the first space communicating oil path 53, as shown in FIG. 8A, is made to communicate with the first pin holding space 64 and the secondary side of the check valve holding space 66 at one side surface from the center of the connecting rod body 31 in the thickness direction (bottom side in FIG. 8B). The other second space communicating oil path 54 is made to communicate with the first pin holding space 64 and the primary side of the check valve holding space 66 at the other side surface from the center of the connecting rod body 31 in the thickness direction (top side in FIG. 8B). Further, the first space communicating oil path 53 and the second space communicating oil path 54 are formed so that the interval between the first space communicating oil path 53 and the first piston communicating oil path 51 in the thickness direction of the connecting rod body and the interval between the second space communicating oil path 54 and the first piston communicating oil path 51 in the thickness direction of the connecting rod body become equal to the interval between the circumferential grooves 61*a* and 61*b* in the thickness direction of the connecting rod body.

Further, the second pin holding space 65 holding the second switching pin 62 is communicated with the check valve holding space 66 through two space communicating oil paths 55 and 56. Among these, the third space communicating oil path 55, as shown in FIG. 8A, is made to communicate with the first pin holding space 64 and the secondary side of the check valve holding space 66 at one side surface from the center of the connecting rod body 31 in the thickness direction (bottom side in FIG. 8B). The other fourth space communicating oil path 56 is made to communicate with the first pin holding space 64 and the primary side of the check valve holding space 66 at the other side surface from the center of the connecting rod body 31 in the thickness direction (top side in FIG. 8B). Further, the third space communicating oil path 55 and the fourth space communicating oil path 56 are formed so that the interval between the third space communicating oil path 55 and the second piston communicating oil path 52 in the thickness direction of the connecting rod body and the interval between the fourth space communicating oil path 56 and the second piston communicating oil path 52 in the thickness direction of the connecting rod body become equal to the interval between the circumferential grooves 62*a* and 62*b* in the thickness direction of the connecting rod body.

These space communicating oil paths 53 to 56 are formed by cutting by a drill etc. from the crankshaft receiving opening 41. Therefore, at the crankshaft receiving opening 41 sides of these space communicating oil paths 53 to 56, extended oil paths 53*a* to 56*a* coaxial with these space communicating oil paths 53 to 56 are formed. In other words, the space communicating oil paths 53 to 56 are formed so that the crankshaft receiving opening 41 is positioned on their extensions. These extended oil paths 53*a* to 56*a* are, for example, closed by the bearing metal 71.

As explained above, the extended oil paths 51*a* to 56*a* are both sealed by bearing metal 71. For this reason, only by using bearing metal 71 to assemble the connecting rod 6 to the crankpin 22, it is possible to close these extended oil paths 51*a* to 56*a* without separately performing processing for closing these extended oil paths 51*a* to 56*a*.

Further, inside the connecting rod body 31, a first control-use oil path 57 for supplying oil pressure to the first switching pin 61 and a second control-use oil path 58 for supplying oil pressure to the second switching pin 62 are formed. The first control-use oil path 57 is communicated with the first pin holding space 64 at the end part at the opposite side to the end part at which the first biasing spring 67 is provided. The second control-use oil path 58 is communicated with the second pin holding space 65 at the end part at the opposite side to the end part at which the second biasing spring 68 is provided. These control-use oil paths 57 and 58 are formed so as to communicate with the crankshaft receiving opening 41 and are communicated with an oil feed device at the outside of the connecting rod 6 through oil paths formed inside the crankpin 22. The oil feed device is, for example, an oil pump driven by rotation of the crankshaft. The oil pump also supplies oil to the intake camshaft 10, exhaust camshaft 13, crankpins 22 of the crankshaft and crank journals, and other lubricated parts. The path from the oil feed device to the crankpins 22 will be explained later.

Therefore, when oil pressure is not being supplied from the oil feed device, the first switching pin 61 and the second switching pin 62 are respectively biased by the first biasing spring 67 and the second biasing spring 68 and, as shown in FIG. 8A, are positioned at the closed end part sides in the pin holding spaces 64 and 65. On the other hand, when a predetermined pressure or more of oil pressure is being supplied from the oil feed device, the first switching pin 61 and the second switching pin 62 are respectively made to move against the biasing force of the first biasing spring 67 and the second biasing spring 68 and are positioned at the opened end part sides in the pin holding spaces 64 and 65.

Furthermore, inside the connecting rod body 31, a refill-use oil path 59 is formed for refilling oil at the primary side of the check valve 63 in the check valve holding space 66 in which the check valve 63 is held. One end part of the refill-use oil path 59 is communicated with the check valve holding space 66 at the primary side of the check valve 63. The other end part of the refill-use oil path 59 is communicated with the crankshaft receiving opening 41. Further, the bearing metal 71 is formed with a through hole 71*a* matched with the refill-use oil path 59. The refill-use oil path 59 is communicated with the oil feed device through this through hole 71*a* and an oil path (not shown) formed inside the crankpin 22. Therefore, due to the refill-use oil path 59, the primary side of the check valve 63 is communicated with the oil feed device constantly or periodically matched with the rotation of the crankshaft.

<Operation of Flow Direction Switching Mechanism>

Figure 9:
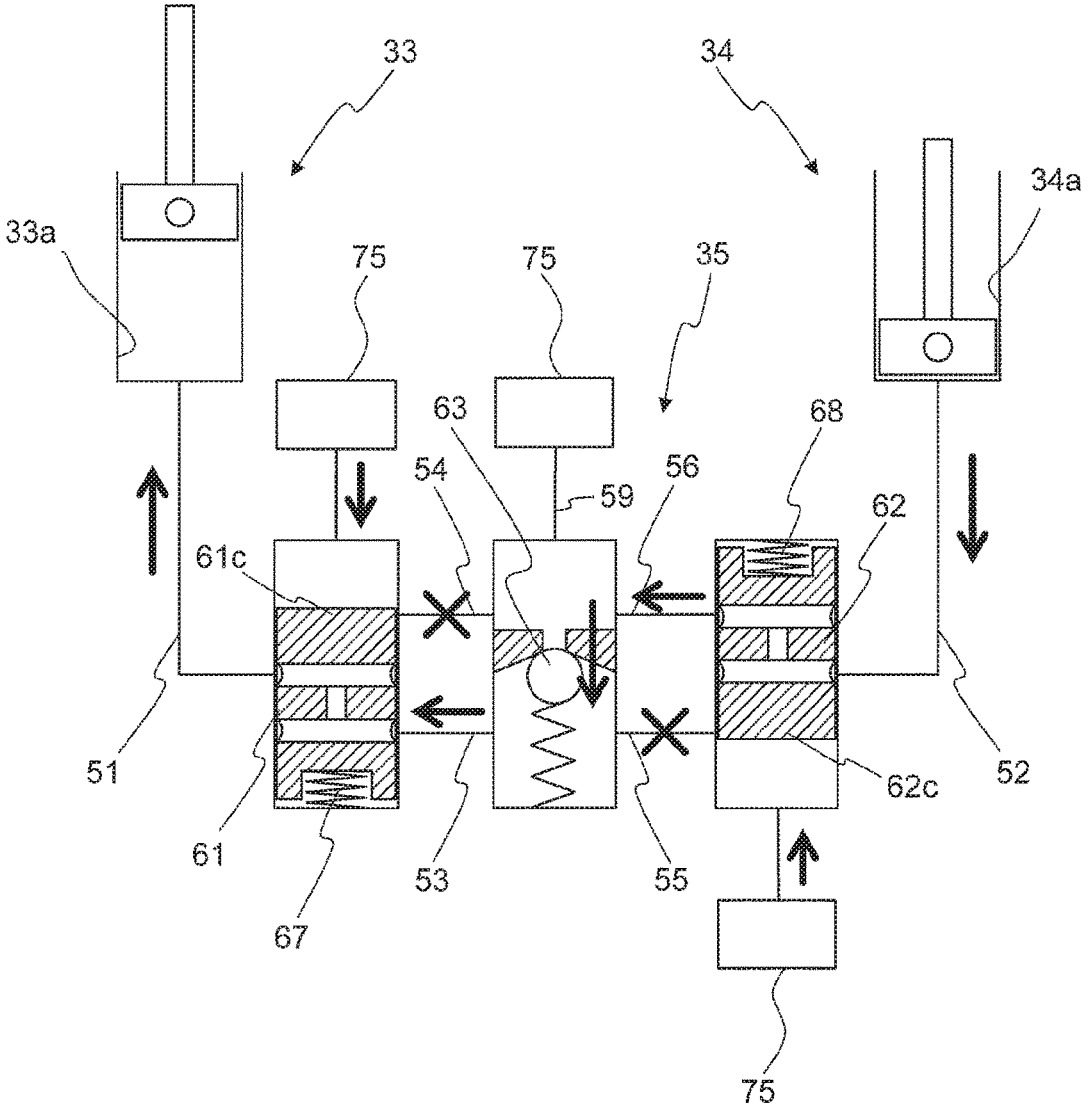
FIG. 9 is a schematic view explaining the operation of a flow direction switching mechanism when oil pressure is supplied from an oil feed device to a switching pin.
Figure 10:
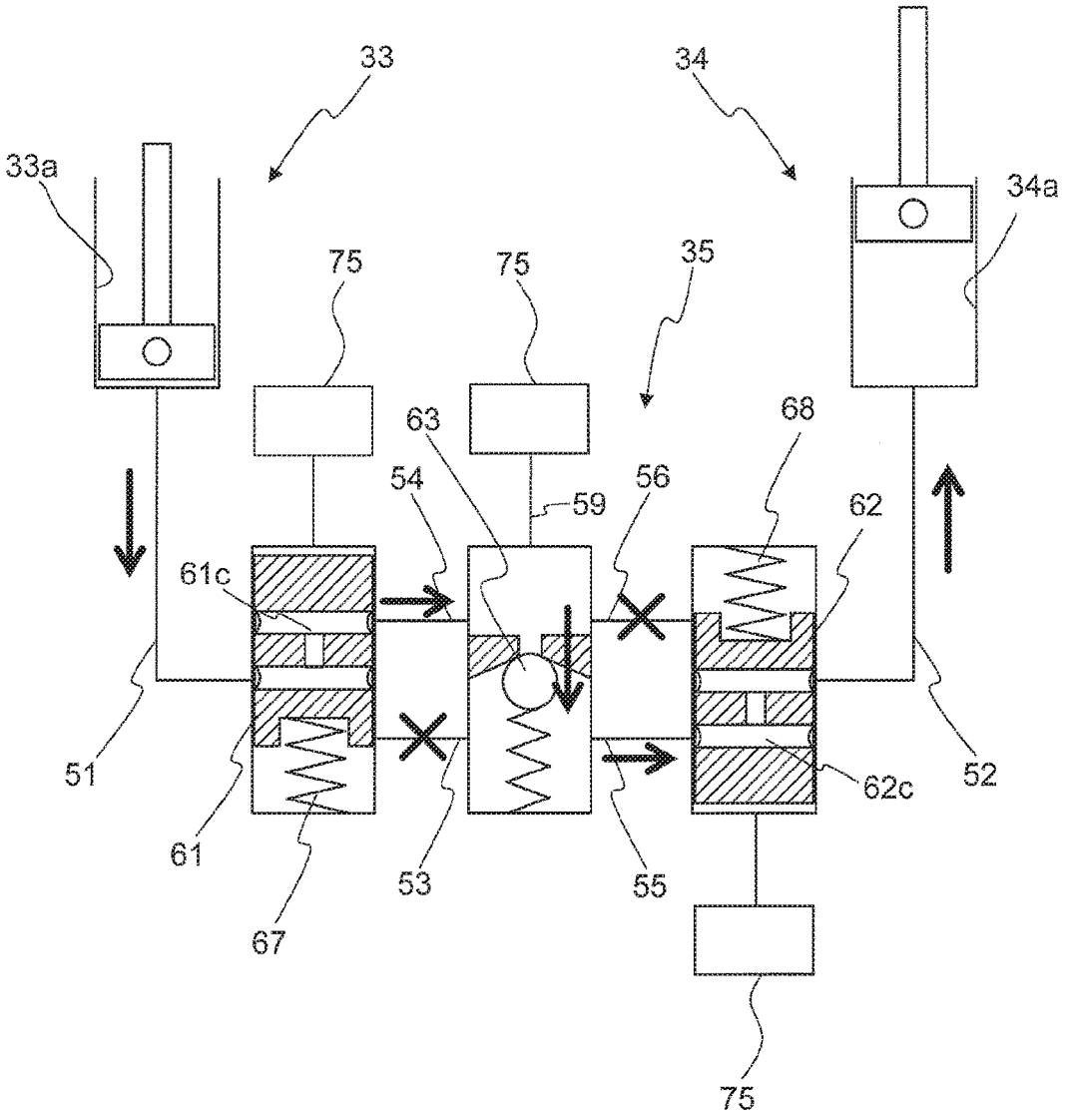
FIG. 10 is a schematic view explaining the operation of a flow direction switching mechanism when oil pressure is not supplied from an oil feed device to a switching pin.

Next, referring to FIG. 9 and FIG. 10, the operation of the flow direction switching mechanism 35 will be explained. FIG. 9 is a schematic view explaining the operation of the flow direction switching mechanism 35 when a predetermined pressure or more of oil pressure is supplied from the oil feed device 75 to the switching pins 61 and 62. Further, FIG. 10 is a schematic view explaining the operation of the flow direction switching mechanism 35 when oil pressure is not supplied from the oil feed device 75 to the switching pins 61 and 62. Note that, in FIG. 9 and FIG. 10, the oil feed device 75 for supplying oil pressure to the first switching pin 61 and the second switching pin 62 and the oil feed device 75 for supplying oil to the refill-use oil path 59 are separately drawn, but in the present embodiment, oil pressure is supplied from the same oil feed device.

As shown in FIG. 9, when a predetermined pressure or more of oil pressure is supplied from the oil feed device 75, the switching pins 61 and 62 are respectively positioned at the first positions where they move against the biasing forces of the biasing springs 67 and 68. As a result of this, due to the communicating path 61*c* of the first switching pin 61, the first piston communicating oil path 51 and the first space communicating oil path 53 are communicated, while due to the communicating path 62*c* of the second switching pin 62, the second piston communicating oil path 52 and the fourth space communicating oil path 56 are communicated. Therefore, the first cylinder 33*a* is connected to the secondary side of the check valve 63, while the second cylinder 34*a* is connected to the primary side of the check valve 63.

Here, the check valve 63 is configured to permit the flow of oil from the primary side where the second space communicating oil path 54 and fourth space communicating oil path 56 communicate to the secondary side where the first space communicating oil path 53 and third space communicating oil path 55 communicate, and to prohibit the reverse flow. Therefore, in the state shown in FIG. 9, oil flows from the fourth space communicating oil path 56 to the first space communicating oil path 53, but oil does not flow in reverse.

As a result of this, in the state shown in FIG. 9, the oil inside the second cylinder 34*a* can be supplied to the first cylinder 33*a* through the oil path in the order of the second piston communicating oil path 52, fourth space communicating oil path 56, first space communicating oil path 53, and first piston communicating oil path 51. However, the oil inside the first cylinder 33*a* cannot be supplied to the second cylinder 34*a*. Therefore, when a predetermined pressure or more of oil pressure is supplied from the oil feed device 75, the flow direction switching mechanism 35 can be said to be in a first state where it prohibits the flow of oil from the first cylinder 33*a* to the second cylinder 34*a* and permits the flow of oil from the second cylinder 34*a* to the first cylinder 33*a*. As a result of this, as explained above, the first piston 33*b* rises and the second piston 34*b* descends, so the effective length of the connecting rod 6 becomes long as shown by L1 in FIG. 6A.

On the other hand, as shown in FIG. 10, when oil pressure is not supplied from the oil feed device 75, the switching pins 61 and 62 are positioned at second positions where they are biased by the biasing springs 67 and 68. As a result of this, due to the communicating path 61*c* of the first switching pin 61, the first piston communicating oil path 51 communicated with the first piston mechanism 33 and the second space communicating oil path 54 are communicated. In addition, due to the communicating path 62*c* of the second switching pin 62, the second piston communicating oil path 52 communicating with the second piston mechanism 34 and the third space communicating oil path 55 are made to communicate. Therefore, the first cylinder 33*a* is connected to the primary side of the check valve 63, while the second cylinder 34*a* is connected to the secondary side of the check valve 63.

Due to the action of the above-mentioned check valve 63, in the state shown in FIG. 10, the oil inside the first cylinder 33*a* can pass through the oil path in the order of the first piston communicating oil path 51, second space communicating oil path 54, third space communicating oil path 55, and second piston communicating oil path 52 and be supplied to the second cylinder 34*a*. However, the oil inside the second cylinder 34*a* cannot be supplied to the first cylinder 33*a*. Therefore, when oil pressure is not being supplied from the oil feed device 75, the flow direction switching mechanism 35 can be said to be in a second state where it permits the flow of oil from the first cylinder 33*a* to the second cylinder 34*a* and prohibits the flow of oil from the second cylinder 34*a* to the first cylinder 33*a*. As a result of this, as explained above, the second piston 34*b* rises and the first piston 33*b* descends, so the effective length of the connecting rod 6 becomes shorter as shown by L2 in FIG. 6B.

Further, in the present embodiment, as explained above, oil travels back and forth between the first cylinder 33*a* of the first piston mechanism 33 and the second cylinder 34*a* of the second piston mechanism 34. For this reason, basically, oil does not have to be supplied from the outside of the first piston mechanism 33, second piston mechanism 34, and flow direction switching mechanism 35. However, oil may leak to the outside from the oil seals 33*c*, 34*c*, etc. provided at these mechanisms 33, 34, and 35. If oil leaks in this way, it has to be refilled from the outside.

In the present embodiment, there is the refill-use oil path 59 at the primary side of the check valve 63. Due to this, the primary side of the check valve 63 is constantly or periodically communicated with the oil feed device 75. Therefore, even if oil leaks from the mechanisms 33, 34, 35, etc., the oil can be refilled.

Furthermore, in the present embodiment, the flow direction switching mechanism 35 is configured to become a first state where the effective length of the connecting rod 6 becomes long when a predetermined pressure or more of oil pressure is supplied from the oil feed device 75 to the switching pins 61 and 62 and to become a second state where the effective length of the connecting rod 6 becomes short when oil pressure is not supplied from the oil feed device 75 to the switching pins 61 and 62. Due to this, for example, when a breakdown at the oil feed device 75 etc. makes it no longer possible to supply oil pressure, it is possible to leave the effective length of the connecting rod 6 short and therefore possible to maintain the mechanical compression ratio low.

<Hydraulic Oil Path and Lubricating Oil Path>

As explained above, the operating members provided at the connecting rod 6, that is, the switching pins 61 and 62, operate by a predetermined pressure or more of oil pressure. Further, in the internal combustion engine 1, to reduce the friction between metals and seizing, lubricating oil is supplied to the intake camshaft 10, exhaust camshaft 13, crankpins 22 of the crankshaft and crank journals, and other lubricated parts. Below, referring to FIG. 11 to FIGS. 16A to 16C, a hydraulic oil path supplying hydraulic oil from the oil feed device 75 to the switching pins 61 and 62 and a lubricating oil path supplying lubricating oil from the oil feed device 75 to the lubricated parts will be explained.

Figure 11:
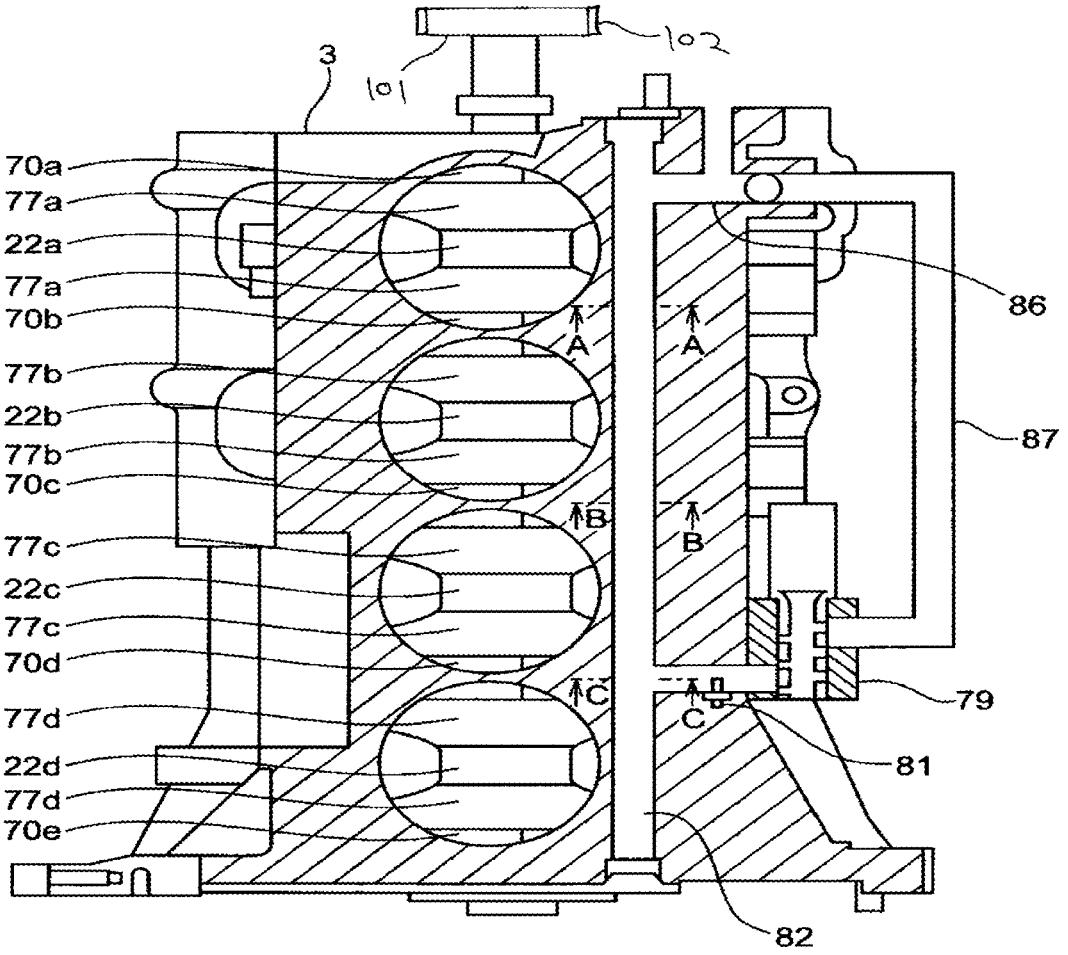
FIG. 11 is a schematic plan cross-sectional view of an internal combustion engine schematically showing a hydraulic oil path and a lubricating oil path according to the present invention.
Figure 12:
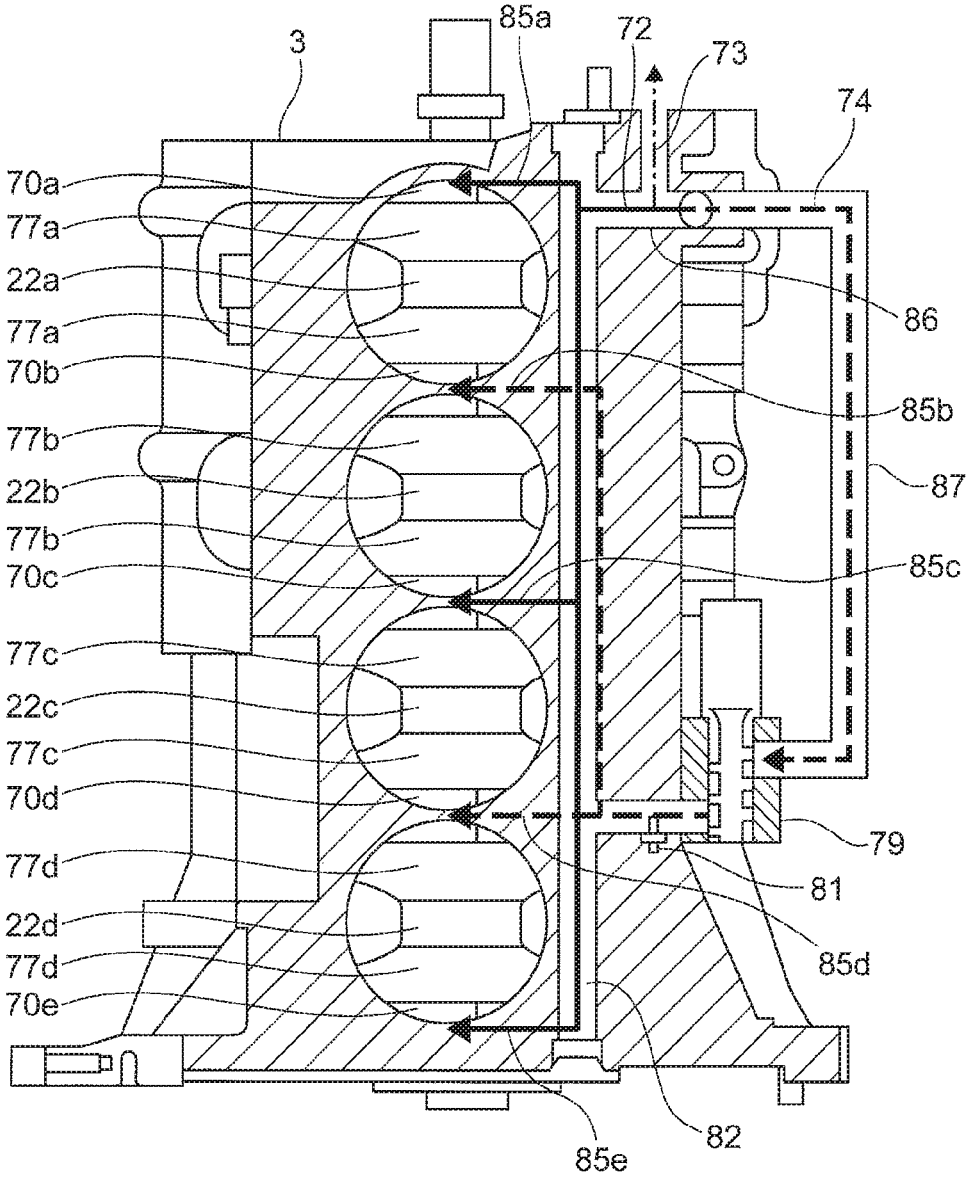
FIG. 12 is a schematic plan cross-sectional view of an internal combustion engine schematically showing a hydraulic oil path and a lubricating oil path according to the present invention.
Figure 13:
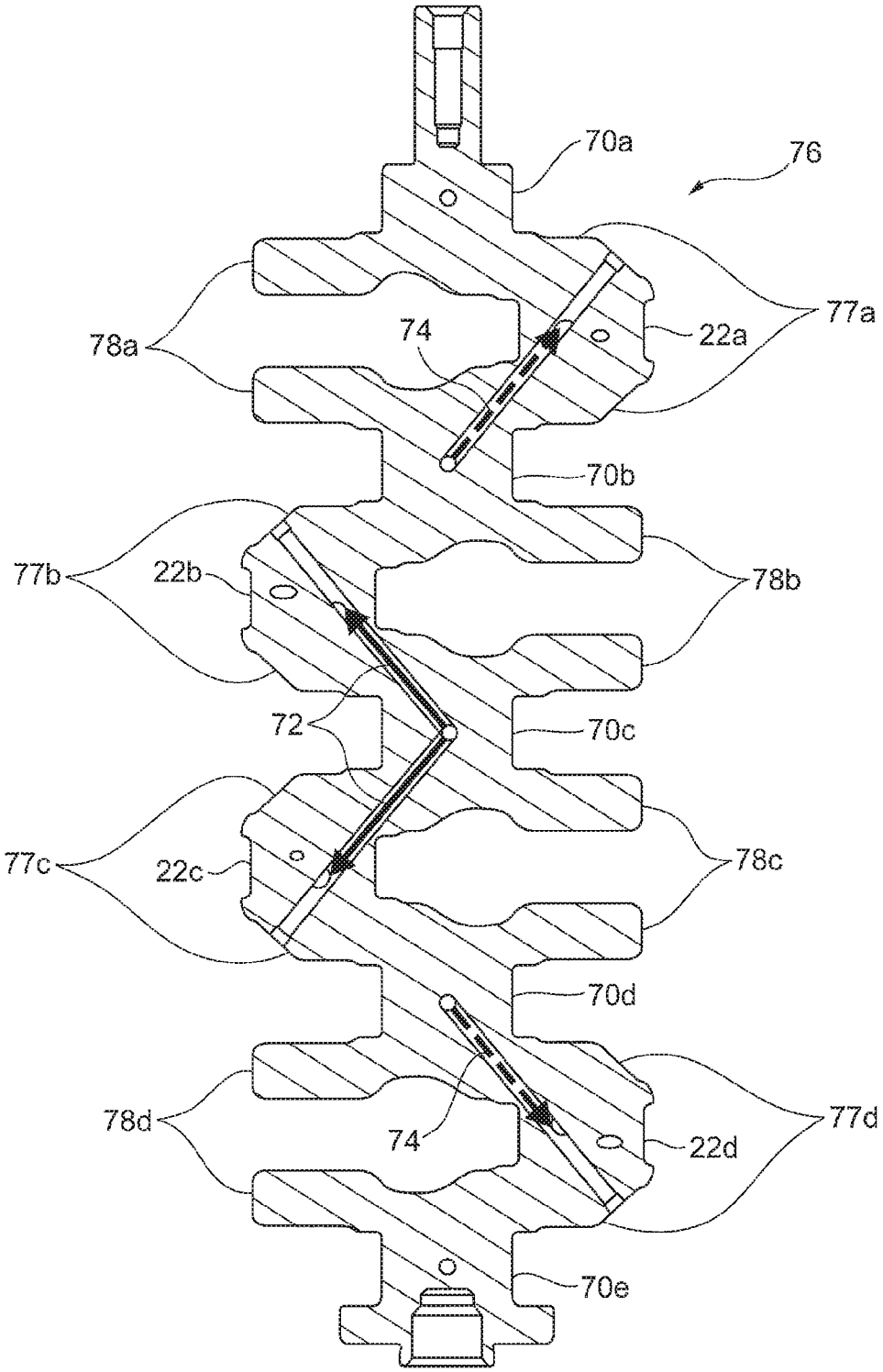
FIG. 13 is a cross-sectional plan view of a crankshaft according to the present invention.
Figure 14:
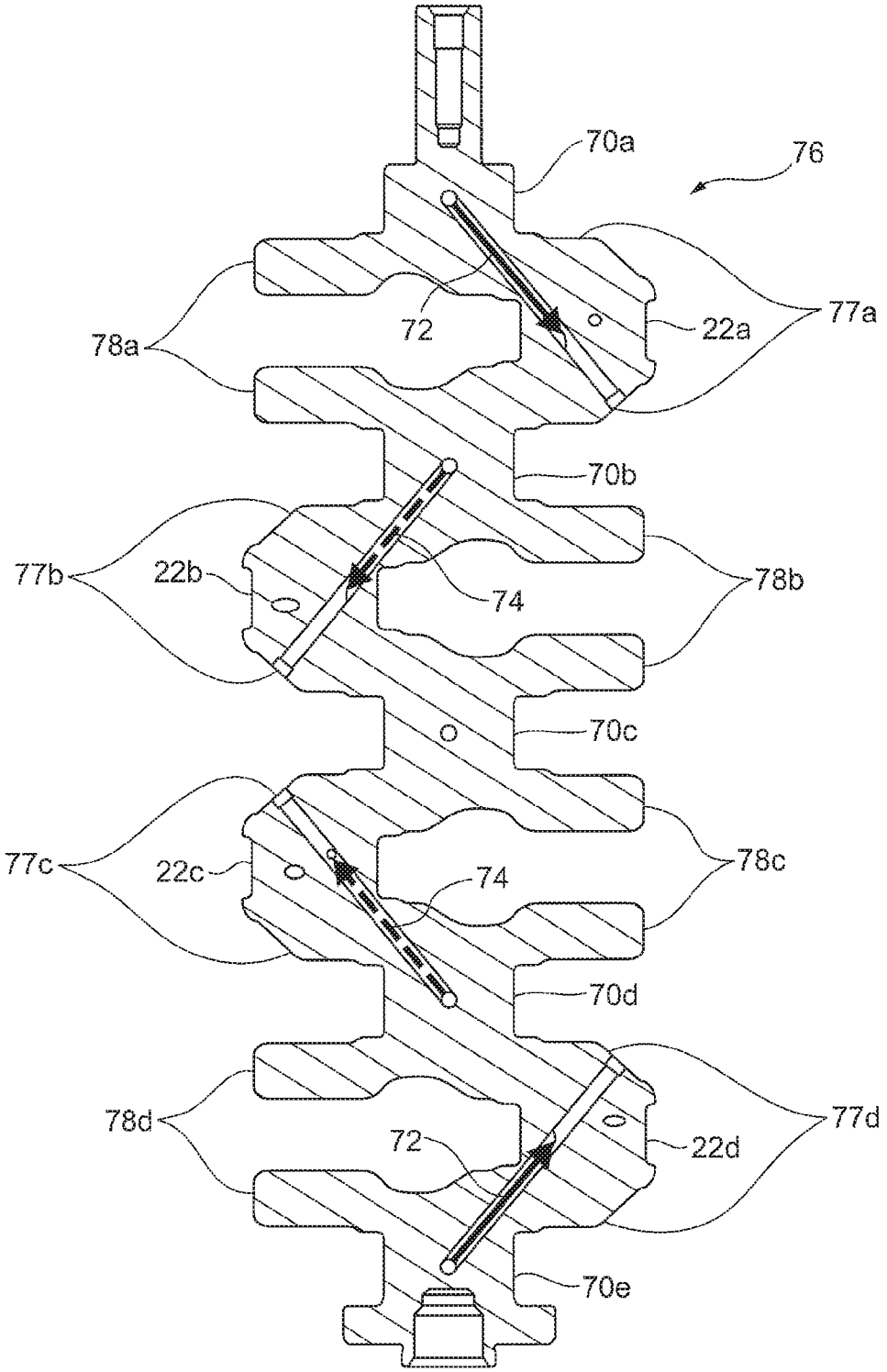
FIG. 14 is a cross-sectional plan view of a crankshaft according to the present invention.
Figure 15:
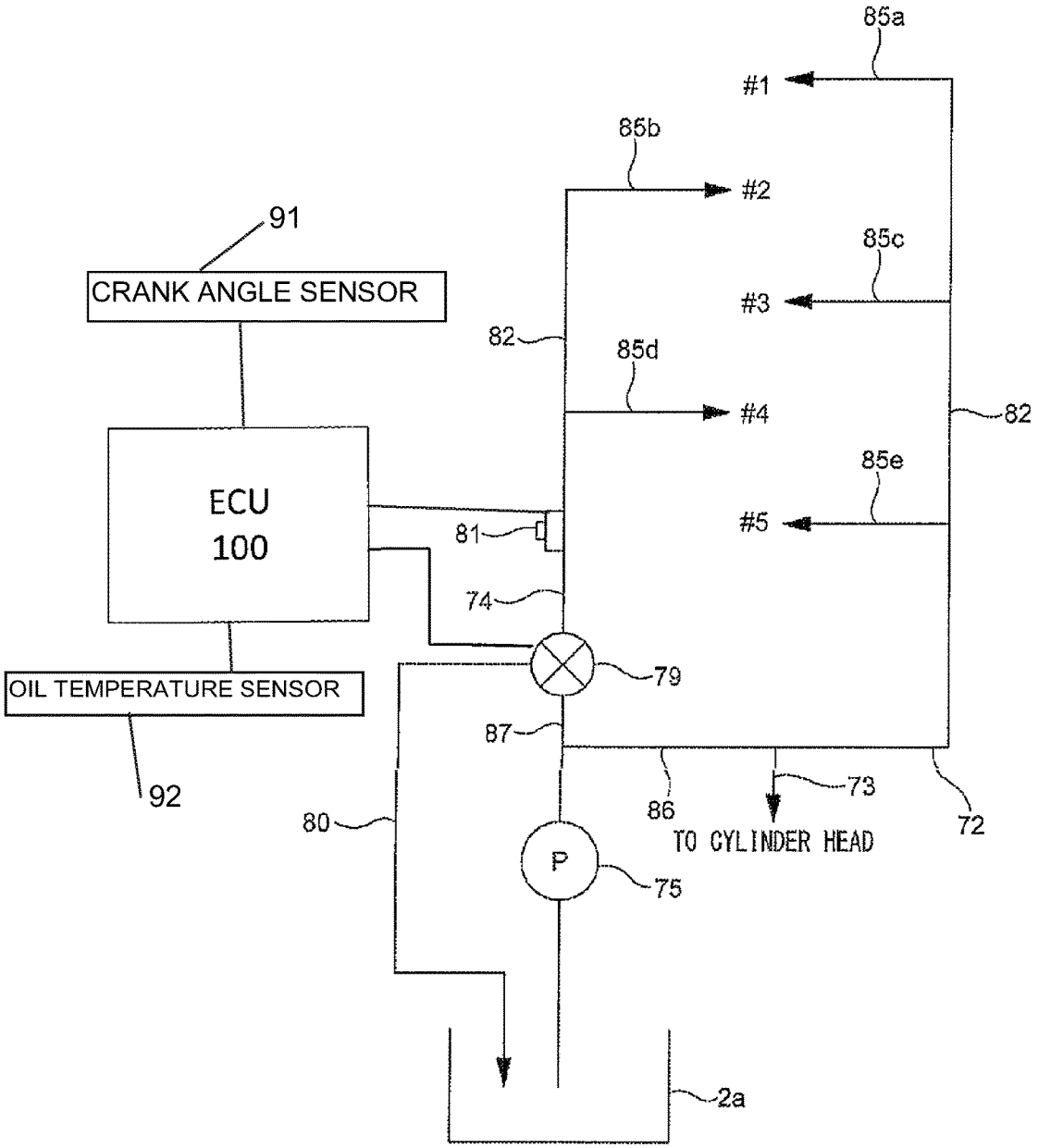
FIG. 15 is a hydraulic circuit diagram in an embodiment of the present invention.

FIG. 11 and FIG. 12 are schematic plan cross-sectional views of an internal combustion engine schematically showing a hydraulic oil path and lubricating oil path according to the present invention. In FIG. 11 and FIG. 12, the cylinder head 4, pistons 5, and connecting rods 6 are omitted. Further, in FIG. 12, the first lubricating oil path 72 for supplying lubricating oil to the crankpins 22*a* to 22*d* is shown by the solid line, the second lubricating oil path 73 for supplying lubricating oil to the intake camshaft 10, exhaust camshaft 13, etc. at the cylinder head 4 side is shown by the one-dot chain line, and the hydraulic oil path 74 is shown by the broken line. FIG. 13 and FIG. 14 are cross-sectional plan views of the crankshaft 76 according to the present invention. Note that, in FIG. 13 and FIG. 14, cross-sectional plan views of the crankshaft 76 at different cross-sections are shown. FIG. 15 is a hydraulic circuit diagram in an embodiment of the present invention.

In the present embodiment, the internal combustion engine 1 is an in-line internal combustion four-cylinder engine. For this reason, the crankshaft 76 comprises five crank journals 70*a* to 70*e*. As shown in FIG. 11 to FIG. 14, the first crank journal 70*a*, second crank journal 70*b*, third crank journal 70*c*, fourth crank journal 70*d*, and fifth crank journal 70*e* are arranged on the crankshaft 76 in the direction of arrangement of the cylinders 15 at predetermined intervals. Between the first crank journal 70*a* and the second crank journal 70*b*, a first crankpin 22*a*, first crankshaft arm 77*a*, and first balance weight 78*a* are arranged. Between the second crank journal 70*b* and third crank journal 70*c*, a second crankpin 22*b*, second crankshaft arm 77*b*, and second balance weight 78*b* are arranged. Between the third crank journal 70*c* and the fourth crank journal 70*d*, a third crankpin 22*c*, third crankshaft arm 77*c*, and third balance weight 78*c* are arranged. Between the fourth crank journal 70*d* and the fifth crank journal 70*e*, a fourth crankpin 22*d*, fourth crankshaft arm 77*d*, and fourth balance weight 78*d* are arranged.

Further, at the end part of the crankshaft 76 at the first crank journal 70*a* side, a crankshaft pulley 101 is fastened. At the crankshaft pulley, a timing belt 102 is attached. Therefore, the first crank journal 70*a* is the crank journal closest to the timing belt among the plurality of crank journals.

As shown in FIG. 12 and FIG. 15, the oil stored in the oil pan 2*a* is sucked up by the oil feed device 75 from the oil pan 2*a* and is distributed to the first lubricating oil path 72, second lubricating oil path 73, and hydraulic oil path 74. As shown by the solid arrows of FIG. 13 and FIG. 14, the first lubricating oil path 72 supplies lubricating oil from the oil feed device 75 through the first crank journal 70*a*, third crank journal 70*c*, and fifth crank journal 70*e* to the first crankpin 22*a* to fourth crankpin 22*d*. More specifically, the lubricating oil is supplied from the first crank journal 70*a* to the first crankpin 22*a*, is supplied from the third crank journal 70*c* to the second crankpin 22*b* and third crankpin 22*c*, and is supplied from the fifth crank journal 70*e* to the fourth crankpin 22*d*. Therefore, while the oil feed device 75 is operating, the first crank journal 70*a*, third crank journal 70*c*, and fifth crank journal 70*e* and the first crankpin 22*a* to fourth crankpin 22*d* are constantly supplied with lubricating oil.

As explained above, in the present embodiment, the first crank journal 70*a*, third crank journal 70*c*, and fifth crank journal 70*e* are formed with the first lubricating oil path 72. In the second crank journal 70*b*, the balance weights 78*a* and 78*b* at the two ends extend in opposite directions from the axis of the crankshaft 76, so the inertial forces generated by the balance weights 78*a* and 78*b* due to rotation of the crankshaft 76 are cancelled out. Therefore, during rotation of the crankshaft 76, the load which the second crank journal 70*b* receives is small. The fourth crank journal 70*d* is also similar to the second crank journal 70*b*. On the other hand, at the third crank journal 70*c*, the balance weights 78*b* and 78*c* of the two ends extend in the same direction, so the inertial forces generated by the balance weights 78*b* and 78*c* due to rotation of the crankshaft 76 are amplified. Therefore, during rotation of the crankshaft 76, the load which the third crank journal 70*c* receives is the greatest. Further, at the first crank journal 70*a* and fifth crank journal 70*e*, the balance weights 78*a* and 78*d* extend to only one side, so the inertial forces generated by the balance weights 78*a* and 78*d* due to rotation of the crankshaft 76 are not cancelled out. Therefore, during rotation of the crankshaft 76, the loads which the first crank journal 70*a* and fifth crank journal 70*e* receive are relatively large. Further, the first crank journal 70*a* is the crank journal closest to the timing belt, so a load from the timing belt is also received.

Therefore, the loads which the first crank journal 70*a*, third crank journal 70*c*, and fifth crank journal 70*e* receive are larger than the loads which the second crank journal 70*b* and fourth crank journal 70*d* receive. For this reason, in the first crank journal 70*a*, third crank journal 70*c*, and fifth crank journal 70*e*, the lubrication request is relatively high. In the present embodiment, by forming the first lubricating oil path 72 at the first crank journal 70*a*, third crank journal 70*c*, and fifth crank journal 70*e*, it is possible to effectively suppress seizing of the crank journals with a large load.

On the other hand, as shown by the broken line arrows in FIG. 13 and FIG. 14, the hydraulic oil path 74 supplies hydraulic oil through the second crank journal 70*b* and fourth crank journal 70*d* to the first crankpin 22*a* to fourth crankpin 22*d*. More specifically, the hydraulic oil is supplied from the second crank journal 70*b* to the first crankpin 22*a* and the second crankpin 22*b* and is supplied from the fourth crank journal 70*d* to the third crankpin 22*c* and fourth crankpin 22*d*. The hydraulic oil supplied to the crankpins 22*a* to 22*d* passes through the control-use oil paths 57 and 58 communicating with the crankshaft receiving opening 41 to the switching pins 61 and 62. Therefore, the hydraulic oil path 74 can supply hydraulic oil through the second crank journal 70*b* and fourth crank journal 70*d* to the switching pins 61 and 62 in all of the (four) connecting rods 6.

Further, as shown in FIG. 12 and FIG. 15, the hydraulic oil path 74 is provided with a hydraulic control valve 79 linearly controlling the oil pressure supplied to the switching pins 61 and 62. The hydraulic control valve 79 is for example a linear solenoid valve (proportional control solenoid valve). In the linear solenoid valve, oil pressure corresponding to the value of the current run through the electromagnetic coil is output.

The hydraulic control valve 79 is arranged at the switching pin 61 and 62 side (oil flow direction downstream side) from the oil feed device 75. Further, the hydraulic control valve 79 has a discharged oil path 80 connected to it. If the opening degree of the hydraulic control valve 79 is not wide open, part of the hydraulic oil supplied to the hydraulic control valve 79 is returned through the discharged oil path 80 to the oil pan 2*a*.

The hydraulic oil path 74 is further provided with a hydraulic sensor 81. The hydraulic sensor 81 can detect the oil pressure controlled by the hydraulic control valve 79, that is, the oil pressure supplied to the switching pins 61 and 62. The hydraulic sensor 81 is arranged at the switching pin 61 and 62 side from the oil feed device 75 and hydraulic control valve 79.

As will be understood from FIG. 12, the main gallery 82 formed inside the cylinder block 3 is formed with two passages. The lubricating oil sucked up by the oil feed device 75 passes through the first pipeline 86 and flows into one passage in the main gallery 82. Therefore, the first pipeline 86 and one passage inside the main gallery 82 form part of the first lubricating oil path 72. Further, the hydraulic oil sucked up by the oil feed device 75 passes through the second pipeline 87 and flows to the other passage inside the main gallery 82. Therefore, the second pipeline 87 and other passage inside the main gallery 82 form part of the hydraulic oil path 74.

The main gallery 82 extends in parallel to the axial direction of the crankshaft 76, that is, the axial direction of the crank journals 70*a* to 70*e*. The main gallery 82 is connected through the first connecting oil path 85*a* to the first crank journal 70*a*, is connected through the second connecting oil path 85*b* to the second crank journal 70*b*, is connected through the third connecting oil path 85*c* to the third crank journal 70*c*, is connected through the fourth connecting oil path 85*d* to the fourth crank journal 70*d*, and is connected through the fifth connecting oil path 85*e* to the fifth crank journal 70*e*. Therefore, the hydraulic oil is supplied from the main gallery 82 to the second crank journal 70*b* and fourth crank journal 70*d*. On the other hand, the lubricating oil is supplied from the main gallery 82 to the first crank journal 70*a*, third crank journal 70*c*, and fifth crank journal 70*e*. Note that, the oil feed device 75, hydraulic control valve 79, and hydraulic sensor 81 are arranged at the upstream side from the main gallery 82 in the direction of oil flow.

Figure 16A:
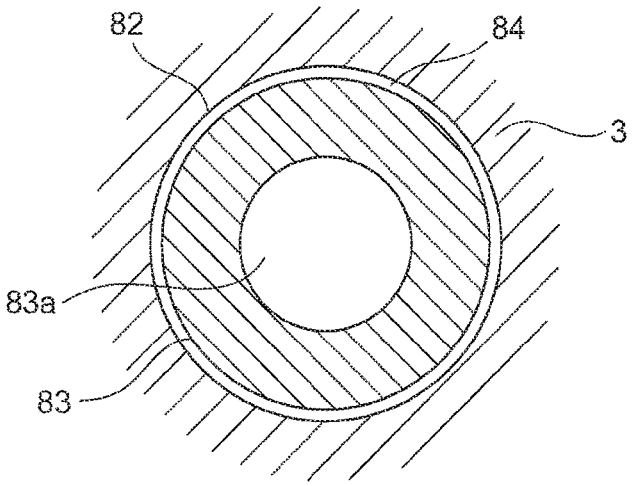
FIGS. 16A to 16C are cross-sectional views along A-A, B-B, and C-C of FIG. 11.
Figure 16B:
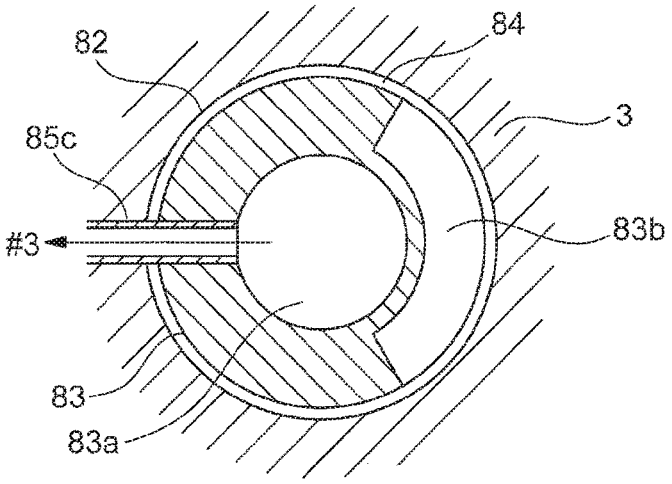
Figure 16C:
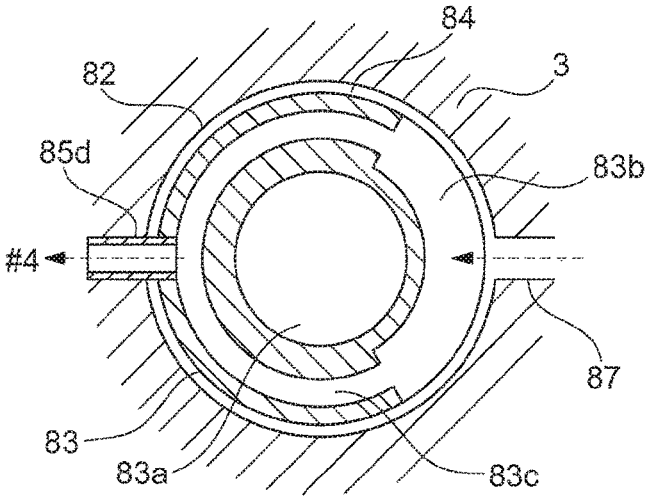

FIGS. 16A to C are respectively cross-sectional views along A-A, B-B, and C-C of FIG. 11. As shown in FIG. 16A, the main gallery 82 has the pipe member 83 inserted into it. The inside 83*a* of the pipe member 83 defines the first lubricating oil path 72.

The bore diameter of the main gallery 82 in the cross-section vertical to the direction of extension of the main gallery 82 (cross-section shown in FIGS. 16A to 16C) is slightly larger than the outside diameter of the pipe member 83. For this reason, a gap 84 is formed between the inside wall of the main gallery 82 and the pipe member 83. At the connecting part of the main gallery 82 and the first pipeline 86, the gap 84 is communicated with the inside 83*a* of the pipe member 83. Therefore, when the oil sucked up by the oil feed device 75 passes through the first pipeline 86 and is supplied to the first lubricating oil path 72 at the inside of the main gallery 82, a small amount of oil flows into the gap 84. Further, the oil which is sucked up by the oil feed device 75 is supplied through the first pipeline 86 to the second lubricating oil path 73 as well. The first pipeline 86 forms part of the first lubricating oil path 72 and the second lubricating oil path 73.

As shown in FIG. 16B and FIG. 16C, the pipe member 83 is formed with a recessed part 83*b* in its direction of extension from the position of the second crank journal 70*b* to the position of the fourth crank journal 70*d*. The recessed part 83*b* and the inside wall of the main gallery 82 define a hydraulic oil path 74. As shown in FIG. 12 and FIG. 16C, hydraulic oil flows through the second pipeline 87 to the recessed part 83*b*.

As shown in FIG. 16B, the inside 83*a* of the pipe member 83 is connected to the third connecting oil path 85*c* at the position of the third crank journal 70*c*. In the same way, the inside 83*a* of the pipe member 83 is connected with the first connecting oil path 85*a* at the position of the first crank journal 70*a* and is connected at the fifth connecting oil path 85*e* at the position of the fifth crank journal 70*e*. Therefore, the lubricating oil is supplied from the inside 83*a* of the pipe member 83 inside the main gallery 82 to the first crank journal 70*a*, third crank journal 70*c*, and fifth crank journal 70*e*.

As shown in FIG. 16C, the pipe member 83 is formed with a circumferential direction groove 83*c* at the position of the fourth crank journal 70*d*. The recessed part 83*b* of the pipe member 83 is connected through the circumferential direction groove 83*c* to the fourth connecting oil path 85*d*. In the same way, the pipe member 83 is formed with a circumferential direction groove 83*c* at the position of the second crank journal 70*b*, while the recessed part 83*b* of the pipe member 83 is connected through the circumferential direction groove 83*c* to the second connecting oil path 85. Therefore, the hydraulic oil is supplied from the recessed part of the pipe member 83 inside the main gallery 82 to the second crank journal 70*b* and fourth crank journal 70*d*.

Further, the recessed part 83*b* of the pipe member 83 is communicated with the gap 84. For this reason, the recessed part 83*b* of the pipe member 83 communicates through the gap 84 with the inside 83*a* of the pipe member 83. Therefore, the hydraulic oil path 74 communicates with the first lubricating oil path 72 at a position at the upstream side from the second crank journal 70*b* and fourth crank journal 70*d* in the direction of oil flow and at the downstream side from the hydraulic control valve 79 in the direction of oil flow. As a result of this, when the first lubricating oil path 72 is supplied with lubricating oil, lubricating oil is supplied from the first lubricating oil path 72 through the gap 84 and recessed part 83*b* of the pipe member 83 to the second crank journal 70*b* and fourth crank journal 70*d*.

The gap 84 is configured so that the oil pressure supplied from the first lubricating oil path 72 to the second crank journal 70*b* and fourth crank journal 70*d* becomes lower than the oil pressure of the switching pins 61 and 62. Due to this, even if the hydraulic control valve 79 breaks down and oil can no longer be supplied from the hydraulic oil path 74 to the second crank journal 70*b* and fourth crank journal 70*d*, it is possible to suppress seizing of the second crank journal 70*b* and fourth crank journal 70*d* by the oil supplied from the first lubricating oil path 72 without causing mistaken operation of the switching pins 61 and 62.

<Control of Hydraulic Control Valve>

The internal combustion engine 1 further comprises a control device 100 (see FIG. 17) controlling the opening degree of the hydraulic control valve 79 based on the output of the hydraulic sensor 81. The control device 100 is for example an electronic control unit (ECU). The ECU also controls the ignition timing of the spark plug 8, the opening timing and closing timing of the intake valve 9, the opening timing and closing timing of the exhaust valve 12, etc.

When operating the switching pins 61 and 62, the control device controls the opening degree of the hydraulic control valve 79 so that oil pressures of the operating pressures of the switching pins 61 and 62 or more are supplied to the switching pins 61 and 62, while when not operating the switching pins 61 and 62, it controls the opening degree of the hydraulic control valve 79 so that oil pressures of less than the operating pressures of the switching pins 61 and 62 are supplied to the switching pins 61 and 62. Due to this, while the oil feed device 75 is operating, it is possible to constantly supply oil to the second crank journal 70*b* and fourth crank journal 70*d* without causing mistaken operation of the switching pins 61 and 62. Therefore, in the present embodiment, in addition to the first crank journal 70*a*, third crank journal 70*c*, and fifth crank journal 70*e*, it is possible to keep down seizing of the second crank journal 70*b* and fourth crank journal 70*d*.

Figure 17:
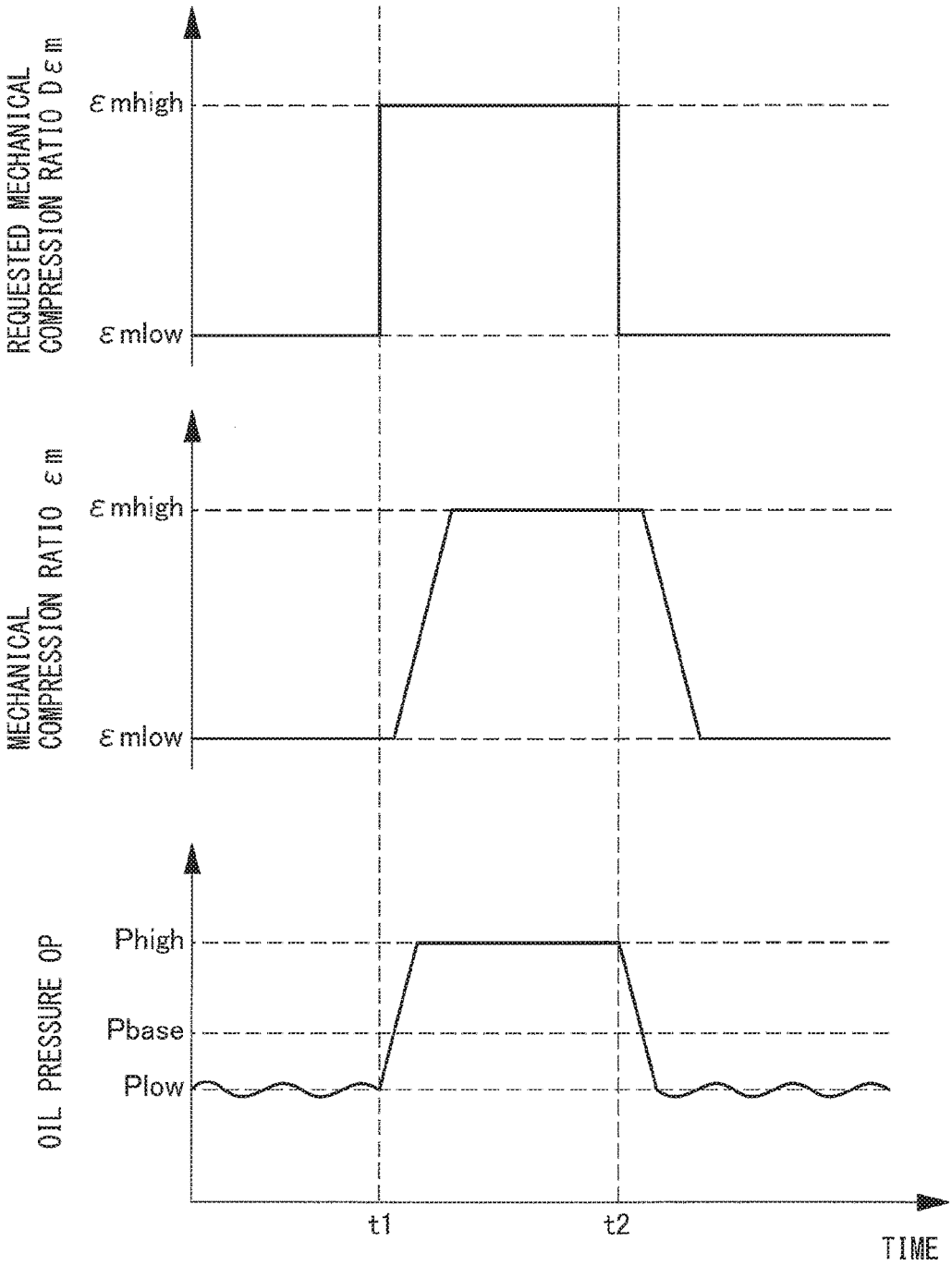
FIG. 17 is a time chart of a requested mechanical compression ratio, a mechanical compression ratio, and an oil pressure when switching of a mechanical compression ratio is requested.

Below, referring to FIG. 17, this control will be specifically explained. FIG. 17 is a time chart of the requested mechanical compression ratio Dεm, mechanical compression ratio εm (actual mechanical compression ratio), and oil pressure OP when switching of the mechanical compression ratio is requested. The oil pressure OP is an estimated value of oil pressure supplied to the switching pins 61 and 62 calculated based on the output of the hydraulic sensor 81.

In the internal combustion engine 1, if a predetermined pressure Pbase or more of oil pressure is supplied from the oil feed device 75 to the switching pins 61 and 62, the switching pins 61 and 62 operate and the flow direction switching mechanism 35 changes from the second state to the first state. As a result of this, the flow of oil from the second cylinder 34*a* to the first cylinder 33*a* is permitted and the mechanical compression ratio εm is switched from the low compression ratio εmlow to the high compression ratio εmhigh.

In the example of FIG. 17, before the time t1, the requested mechanical compression ratio Dεm and mechanical compression ratio εm become a low compression ratio εmlow. For this reason, before the time t1, the control device controls the opening degree of the hydraulic control valve 79 based on the output of the hydraulic sensor 81 so that the lubrication-use oil pressure Plow is supplied to the switching pins 61 and 62. The lubrication-use oil pressure Plow is lower than the predetermined pressure Pbase where the switching pins 61 and 62 operate.

Even if the opening degree of the hydraulic control valve 79 is constant, the oil pressure OP fluctuates according to the engine speed or the temperature of the hydraulic oil. Specifically, the oil pressure OP becomes higher the higher the engine speed when the oil feed device 75 is driven by rotation of the crankshaft 76. Further, the oil pressure OP becomes higher the lower the temperature of the hydraulic oil, since the viscosity of the hydraulic oil becomes higher the lower the temperature of the hydraulic oil. In the present embodiment, the hydraulic control valve 79 can linearly control the pressure of the hydraulic oil based on the output of the hydraulic sensor 81, so can control the oil pressure OP to a predetermined value. Due to this, while the mechanical compression ratio εm is set to the low compression ratio εmlow, it is possible to supply a suitable amount of lubricating oil to the second crank journal 70*b* and fourth crank journal 70*d* without causing mistaken operation of the switching pins 61 and 62. Therefore, in the present embodiment, seizing of the second crank journal 70*b* and the fourth crank journal 70*d* is inhibited.

Note that, to make the oil pressure supplied to the switching pins 61 and 62 become a predetermined value, in addition to the output of the hydraulic sensor 81 or instead of the output of the hydraulic sensor 81, the opening degree of the hydraulic control valve 79 may be controlled based on the temperature of the hydraulic oil and engine speed. Specifically, when not making the switching pins 61 and 62 operate, the control device makes the opening degree of the hydraulic control valve 79 smaller when the oil temperature of the hydraulic oil is relatively low compared with when the oil temperature of the hydraulic oil is relatively high, and makes the opening degree of the hydraulic control valve 79 smaller when the engine speed is relatively high compared with when the engine speed is relatively low so that the oil pressure supplied to the switching pins 61 and 62 becomes the lubrication-use oil pressure Plow. In other words, when not making the switching pins 61 and 62 operate, the control device makes the opening degree of the hydraulic control valve 79 smaller in steps or linearly as the oil temperature of the hydraulic oil becomes lower, and makes the opening degree of the hydraulic control valve 79 smaller in steps or linearly as the engine speed becomes higher. Due to this, while the mechanical compression ratio εm is set to the low compression ratio εmlow, a suitable amount of lubricating oil can be supplied to the second crank journal 70*b* and fourth crank journal 70*d* without causing mistaken operation of the switching pins 61 and 62. Note that, the temperature of the hydraulic oil can, for example, be detected by an oil temperature sensor 92 provided at the internal combustion engine 1. Further, the engine speed is calculated by a crank angle sensor 91 provided at the internal combustion engine 1.

Further, in the example of FIG. 17, although the lubrication-use oil pressure Plow is made constant, the lubrication-use oil pressure Plow may also be changed in accordance with the operating state of the internal combustion engine 1 as long as the lubrication-use oil pressure Plow is less than a predetermined pressure Pbase. For example, the lubrication-use oil pressure Plow may also be set higher the higher the engine load. The reason is that the lubrication requests of the second crank journal 70*b* and fourth crank journal 70*d* become higher the higher the engine load.

In the example of FIG. 17, at the time t1, the requested mechanical compression ratio Dεm is switched from the low compression ratio εmlow to the high compression ratio εmhigh. For this reason, at the time t1, the control device controls the opening degree of the hydraulic control valve 79 so that the working-use oil pressure Phigh is supplied to the switching pins 61 and 62. In the example of FIG. 17, the opening degree of the hydraulic control valve 79 from the time t1 to the time t2 is fully opened. Note that, if the working-use oil pressure Phigh is a predetermined pressure Pbase or more, the opening degree of the hydraulic control valve 79 when making the switching pins 61 and 62 operate need not be fully opened.

After the time t1, the oil pressure OP rises to the working-use oil pressure Phigh and is maintained at the working-use oil pressure Phigh until the time t2. If the oil pressure OP becomes a predetermined pressure Pbase or more, the switching pins 61 and 62 operate and the mechanical compression ratio εm starts to change from the low compression ratio εmlow toward the high compression ratio εmhigh. The mechanical compression ratio εm is maintained at the high compression ratio εmhigh after that.

In the example of FIG. 17, at the time t2, the requested mechanical compression ratio Dεm is switched from the high compression ratio εmhigh to the low compression ratio εmlow. For this reason, at the time t2, the control device controls the opening degree of the hydraulic control valve 79 based on the output of the hydraulic sensor 81 so that the lubrication-use oil pressure Plow is supplied to the switching pins 61 and 62.

Above, suitable embodiments according to the present invention were explained, but the present invention is not limited to these embodiments and can be modified and changes in various ways within the language of the claims. For example, as long as an operating member operated by the hydraulic oil is provided at the connecting rod 6, it may be an operating member other than the switching pins 61 and 62.

REFERENCE SIGNS LIST

1. internal combustion engine
5. piston
6. connecting rod
15. cylinder
21. piston pin
22. crankpin
35. flow direction switching mechanism
61. first switching pin
62. second switching pin
75. oil feed device
70*a*. first crank journal
70*b*. second crank journal
70*c*. third crank journal
70*d*. fourth crank journal
70*e*. fifth crank journal
72. first lubricating oil path
74. hydraulic oil path
75. oil feed device
79. hydraulic control valve
81. hydraulic sensor

The invention claimed is:

1. An internal combustion engine comprising:

switching pins provided at a connecting rod, the switching pins operating when an oil pressure is greater than or equal to a predetermined pressure, a hydraulic oil path supplying a first amount of an oil from an oil feed device to operate the switching pins through a first plurality of crank journals, and a lubricating oil path supplying a second amount of the oil from the oil feed device to lubricate crankpins through a second plurality of crank journals, a hydraulic control valve provided in the hydraulic oil path for linearly controlling the oil pressure supplied to the switching pins via a change of an opening degree of the hydraulic control valve, and an electronic control unit (ECU) programmed to control the opening degree of the hydraulic control valve based on at least one of an output from a hydraulic sensor, an oil temperature sensor, and a crank angle sensor, wherein when operating the switching pins, the ECU controls the opening degree of the hydraulic control valve such that the oil pressure supplied to the switching pins is greater than or equal to the predetermined pressure, and when not operating the switching pins, the ECU controls the opening degree of the hydraulic control valve such that the oil pressure supplied to the switching pins is less than the predetermined pressure, and when not operating the switching pins, the ECU is configured to make the opening degree of the hydraulic control valve smaller as a temperature of the oil sensed by the oil temperature sensor decreases and as an engine speed sensed by the crank angle sensor increases.

2. The internal combustion engine according to claim 1, wherein the hydraulic sensor is provided in the hydraulic oil path at a switching pin side downstream from the hydraulic control valve for detecting the oil pressure supplied to the switching pins.

3. The internal combustion engine according to claim 1, wherein the hydraulic oil path is communicated with the lubricating oil path at a position on an upstream side of the first plurality of crank journals in a direction of oil flow and on a downstream side of the hydraulic control valve in the direction of oil flow so that the oil pressure less than the predetermined pressure is supplied from the lubricating oil path to the first plurality of crank journals when the lubricating oil path is supplied with the second amount of the oil.

4. The internal combustion engine according to claim 2, wherein the hydraulic oil path is communicated with the lubricating oil path at a position on an upstream side of the first plurality of crank journals in a direction of oil flow and on a downstream side of the hydraulic control valve in the direction of oil flow so that the oil pressure less than the predetermined pressure is supplied from the lubricating oil path to the first plurality of crank journals when the lubricating oil path is supplied with the second amount of the oil.

5. The internal combustion engine according to claim 1, wherein a main gallery in a cylinder block is formed with two passages, the two passages respectively defining portions of the hydraulic oil path and the lubricating oil path, the first amount of the oil being supplied from the main gallery to the first plurality of crank journals via a first passage of the two passages, and the second amount of the oil being supplied from the main gallery to the second plurality of crank journals via a second passage of the two passages.

6. The internal combustion engine according to claim 2, wherein a main gallery in a cylinder block is formed with two passages, the two passages respectively defining portions of the hydraulic oil path and the lubricating oil path, the first amount of the oil being supplied from the main gallery to the first plurality of crank journals via a first passage of the two passages, and the second amount of the oil being supplied from the main gallery to the second plurality of crank journals via a second passage of the two passages.

7. The internal combustion engine according to claim 3, wherein a main gallery in a cylinder block is formed with two passages, the two passages respectively defining portions of the hydraulic oil path and the lubricating oil path, the first amount of the oil being supplied from the main gallery to the first plurality of crank journals via a first passage of the two passages, and the second amount of the oil being supplied from the main gallery to the second plurality of crank journals via a second passage of the two passages.

8. The internal combustion engine according to claim 4, wherein a main gallery in a cylinder block is formed with two passages, the two passages respectively defining portions of the hydraulic oil path and the lubricating oil path, the first amount of the oil being supplied from the main gallery to the first plurality of crank journals via a first passage of the two passages, and the second amount of the oil being supplied from the main gallery to the second plurality of crank journals via a second passage of the two passages.

9. The internal combustion engine according to claim 1, wherein one of the second plurality of crank journals is a crank journal closest to a timing belt.

* * * * *